US010362412B2

(12) United States Patent
Lesimple et al.

(10) Patent No.: US 10,362,412 B2
(45) Date of Patent: Jul. 23, 2019

(54) HEARING DEVICE COMPRISING A DYNAMIC COMPRESSIVE AMPLIFICATION SYSTEM AND A METHOD OF OPERATING A HEARING DEVICE

(71) Applicant: Oticon A/S, Smørum (DK)

(72) Inventors: Christophe Lesimple, Berne (CH); Neil Hockley, Berne (CH); Miguel Sans, Berne (CH)

(73) Assignee: Oticon A/S, Smørum (DK)

( * ) Notice: Subject to any disclaimer, the term of this patent is extended or adjusted under 35 U.S.C. 154(b) by 171 days.

(21) Appl. No.: 15/389,143

(22) Filed: Dec. 22, 2016

(65) Prior Publication Data

US 2018/0184213 A1 Jun. 28, 2018

(51) Int. Cl.
*G10L 25/84* (2013.01)
*H04R 25/00* (2006.01)

(52) U.S. Cl.
CPC ..... *H04R 25/356* (2013.01); *G10L 25/84* (2013.01); *H04R 2225/41* (2013.01); *H04R 2225/43* (2013.01); *H04R 2430/03* (2013.01)

(58) Field of Classification Search
CPC ..... H04R 25/356; H04R 2225/41; H04R 2225/43; H04R 2430/03
(Continued)

(56) References Cited

U.S. PATENT DOCUMENTS 6,198,830 B1 3/2001 Holube et al.
2002/0057808 A1* 5/2002 Goldstein ..... H04R 25/356 381/106
(Continued)

FOREIGN PATENT DOCUMENTS

WO 2375781 A1 10/2011
WO 2012/161717 A1 11/2012
WO 2014/166525 A1 10/2014

OTHER PUBLICATIONS

Doblinger, "Computationally efficient speech enhancement by spectral minima tracking in subbands," Proceedings of Euro Speech, vol. 2, 1995, 4 pages.
(Continued)

*Primary Examiner* — Sean H Nguyen
(74) *Attorney, Agent, or Firm* — Birch, Stewart, Kolasch & Birch, LLP

(57) ABSTRACT

A hearing device, e.g. a hearing aid, comprises A) an input unit providing an electric input signal with a first dynamic range of levels comprising a target signal and/or a noise signal; B) an output unit providing output stimuli; C) a dynamic compressive amplification system comprising c1) a level detector unit providing a level estimate of the electric input signal; c2) a level post processing unit for providing a modified level estimate in dependence of a first control signal; c3) a level compression unit for providing a compressive amplification gain in dependence of the modified level estimate and a user's hearing data; and c4) a gain post processing unit for providing a modified compressive amplification gain in dependence of a second control signal; D) a control unit configured to provide a classification of said electric input signal, and to provide said first and second control signals based on said classification; and E) a forward gain unit for applying the modified compressive amplification gain to the electric input signal. A method of operating a hearing device is furthermore provided.

17 Claims, 19 Drawing Sheets

(58) Field of Classification Search
USPC ..... 381/320
See application file for complete search history.

(56) References Cited

U.S. PATENT DOCUMENTS

| | | | | |
|---|---|---|---|---|
| 2003/0028374 | A1 | 2/2003 | Ribic | |
| 2012/0020485 | A1 | 1/2012 | Visser et al. | |
| 2012/0250883 | A1* | 10/2012 | Narita | G10L 21/0208 381/94.1 |
| 2012/0263329 | A1* | 10/2012 | Kjeldsen | H04R 25/505 381/315 |
| 2014/0133666 | A1* | 5/2014 | Tanaka | H04R 3/00 381/66 |
| 2016/0322068 | A1 | 11/2016 | Muesch | |

OTHER PUBLICATIONS

Ephraim et al., "Speech enhancement using a minimum mean-square error log-spectral amplitude estimator," IEEE Transactions on Acoustics, Speech and Signal Processing, vol. ASSP-33, No. 2, Apr. 1985, pp. 443-445.

Naylor et al., "Long-term Signal-to-Noise Ratio at the input and output of amplitude compression systems," Journal of the American Academy of Audiology, vol. 20, No. 3, 2009, pp. 161-171.

Naylor, "Theoretical Issues of Validity in the Measurement of Aided Speech Reception Threshold in Noise for Comparing Nonlinear Hearing Aid Systems," Journal of the American Academy of Audiology, vol. 27, No. 7, 2016, pp. 504-514.

Scollie et al., "The Desired Sensation Level Multistage Input/Output Algorithm," Trends in Amplification, vol. 9, No. 4, 2005, pp. 159-197.

* cited by examiner

HEARING DEVICE COMPRISING A DYNAMIC COMPRESSIVE AMPLIFICATION SYSTEM AND A METHOD OF OPERATING A HEARING DEVICE

SUMMARY

The present application deals with a hearing device, such as a hearing aid, comprising a dynamic compressive amplification system for adapting a dynamic range of levels of an input sound signal, e.g. adapted to a reduced dynamic range of a person, e.g. a hearing impaired person, wearing the hearing device. Embodiments of the present disclosure address the problem of undesired amplification of noise produced by applying (traditional) compressive amplification to noisy signals.

By restoring audibility for soft signals while maintaining comfort for louder signals, compressive amplification (CA) has been designed to overcome degraded speech perception caused by sensorineural hearing loss (hearing loss compensation, HLC).

Fitting rationales, either proprietary or generic (e.g. NAL-NL2 of the National Acoustic Laboratories, Australia, cf. e.g. [Keidser et al.; 2011]), provide target gain and compression ratios for speech in quiet. The only exception to this is the work that Western University has generated targets for DSLm[i/o] 5.0 (Desired Sensation Level (DSL) version 5.0 of the Western University, Ontario, Canada, cf. e.g. [Scollie et al.; 2005]) for speech in noise, however to date these targets have not been widely adopted by the hearing aid industry.

In summary, classic CA schemes, used in today's hearing aids (HA), are designed and fitted for speech in quiet. They apply gain and compression independently of the amount of noise present in the environment, which typically leads to two main issues:

1. SNR Degradation in Noisy Speech Environment
2. Undesired Amplification in a pure noise environment The next sub-sections below describe these two issues as well as the traditional countermeasure usually implemented in current HA.

Issue 1: SNR Degradation in Noisy Speech Environment

In a noisy speech condition (positive, but non-infinite long-term signal-to-noise ratio (SNR)), classic CA causes a long-term SNR degradation proportional to the static compression ratio, the time domain resolution (i.e. the level estimation time constants) and the frequency resolution (i.e. the number of level estimation sub-bands). [Naylor & Johannesson; 2009] have shown that the long-term SNR at the output of a compression system may be higher or lower than the long-term SNR at the input. This is dependent on interactions between the actual long term input SNR within the environment, the modulation characteristics of the signal and the noise, and additionally, the characteristics of the compression of the system (e.g. level estimation time constants, number of level estimation channels and compression ratio). SNR requirements for individuals with a hearing loss may vary greatly dependent upon a number of factors (see [Naylor; 2016)]) for a discussion of this and other issues.

It should be remembered that using a noise reduction (NR) system to improve the long-term SNR, will not prevent the long-term SNR degradation caused by classic CA:

If the NR is placed before the CA, the long-term SNR improvement obtained by the NR might be, at least partially, potentially undone by the CA.

If the NR is placed after the CA, the long-term SNR degradation caused by the CA might increase the stress on the NR.

Issue 2: Undesired Noise Amplification in Pure Noise Environment

In more or less noisy environments where speech is absent (SNR close to minus infinity), classic CA applies gain as if the input signal was clean speech at the same level, which might not be desirable from an end-user point of view, and is counter effective from a noise management point of view (a noise reduction (NR) system that is usually embedded in a HA):

If the NR is placed before the CA, the CA applies a gain on the noise signal that is proportional to the attenuation applied by the NR. The desired noise attenuation realized by the NR is, at least partially, potentially undone by the CA.

If the NR is placed after the CA, the noise amplification caused by the CA increases the stress on the NR.

Traditional Countermeasure: Environment Specific CA Configuration:

The above described two issues occur in particular sound environments (soundscapes). Hearing loss compensation in the environments speech in noise, quiet/soft noise or loud noise, requires other CA configuration approaches than the environment speech in quiet. Traditionally, the solution proposed to the above two issues has been based on environmental classification: The measured soundscape is classified as a pre-defined type of environment, typically:

speech in quiet,
speech in noise
loud noise
quiet/soft noise.

For each environment, the characteristics of the compression scheme might be corrected, applying some offsets on the settings (see below). The classification might either use:

Hard Decision: Each measured soundscape is described as a pre-defined environment to which some distance measure is minimized. The corresponding offset settings are applied.

Soft Decision: Each soundscape is described as a combination of the pre-defined environments. The weight of each environment in the combination is inversely proportional to some distance measure. The offset settings employed are generated by "fading" the pre-defined settings together using the respective weights (e.g. a linear combination).

Alleviating Issue 1 with Environment Specific CA Configuration

In classic CA schemes, the long-term SNR degradation (issue 1) is often limited by applying the following steps 1. Detect the environment speech in noise
2. Apply the corresponding offsets setting that linearize the CA Linearization can typically be accomplished by:

1. reducing the compression ratio,
2. increasing the level estimation time constants, and/or
3. reducing the number of level estimation channels However, such a solution has severe limitations:

1 Among the three linearization methods listed above, only the first two methods can easily be realized with a dynamic design (controllable time constants and/or compression ratios). Designs based on a dynamically variable number of level estimation channels might be highly complex.

2. Environment classification tends to act very slowly to guarantee stable and smooth environment tracking, even if a 'Soft Decision' is used. Consequently, short-term SNR variations (loud speech phonemes alternating with soft speech phonemes and short speech pauses) cannot be handled properly. The background noise during speech pauses might become too loud (over-amplification) if the CA is not enough linearized. Inversely, loud speech might become uncomfortably loud while soft speech might be inaudible (over-respectively under-amplification) if the CA is linearized too strongly.
3. The relative rough clustering of the environments, in particular if a 'Hard Decision' is used, might lead to some sub-optimal behavior.

More generally, limiting the long-term SNR degradation by directly acting on the configuration of either the compression ratio, the level estimation time constants and/or the number of level estimation channels is actually a reduction of the degree of freedom required in the optimization of speech audibility restoration, i.e. the hearing loss compensation (HLC), which is actually the ultimate goal of CA.

It should be remembered (as mentioned above) that using a noise reduction (NR) system to improve the long-term SNR, will not prevent the long-term SNR degradation caused by classic CA.

Alleviating Issue 2 with Environment Specific CA Configuration

In classic CA schemes, the undesired amplification in pure noise environment (issue 2) is often limited by applying the following steps 1. Detect the environments quiet/soft noise or loud noise
2. Apply the corresponding offset settings to reduce the gain Such negative gain offsets (attenuation offsets) can typically be applied to the CA characteristic curves defined during the fitting of the HA.

However, such a solution might have a practical limitation: The environment classification engine is designed to solve issue 1 and 2. Because of that, it is trained to discriminate at least 3 environments: noise, speech in noise, speech in quiet. Assuming issue 1 is solved by another dedicated engine, the classification engine can be made more robust if it only has to behave like a voice activity detector (VAD), i.e. if it has to discriminate the environments speech present and speech absent.

A Hearing Device:

It is an object of the present disclosure to provide a dynamic system that decreases the negative impact of state of the art compressive amplification (CA) in noisy environments.

In an aspect of the present application, a hearing device, e.g. a hearing aid, is provided. The hearing device comprises An input unit for receiving or providing an electrical input signal with a first dynamic range of levels representative of a time and frequency variant sound signal, the electric input signal comprising a target signal and/or a noise signal;

An output unit for providing output stimuli perceivable by a user as sound representative of said electric input signal or a processed version thereof; and A dynamic compressive amplification system comprising A level detector unit for providing a level estimate of said electrical input signal;

A level post processing unit for providing a modified level estimate of said electric input signal in dependence of a first control signal;

A level compression unit for providing compressive amplification gain in dependence of said modified level estimate and hearing data representative of a user's hearing ability;

A gain post processing unit for providing a modified compressive amplification gain in dependence of a second control signal.

The hearing device further comprises,

A control unit configured to analyze said electric input signal and to provide a classification of said electric input signal and providing said first and second control signals based on said classification; and A forward gain unit for applying said modified compressive amplification gain to said electric input signal or a processed version thereof.

Thereby an improved compression system for a hearing aid may be provided.

In the following the dynamic compressive amplification system according to the present disclosure is termed the 'SNR driven compressive amplification system' and abbreviated SNRCA.

The SNR driven compressive amplification system (SNRCA) is a compressive amplification (CA) scheme that aims to:

Minimize the long-term SNR degradation caused by CA. This functionality is termed the "Compression Relaxing" feature of SNRCA.

Apply a (configured) reduction of the prescribed gain for very low SNR (i.e. noise only) environment. This functionality is termed the "Gain Relaxing" feature of SNRCA.

Compression Relaxing

The SNR degradation caused by CA is minimized on average. The CA is only linearized when the SNR of the input signal is locally low (see below) causing minimal reduction of the HLC performance, when:

the short-term SNR is low, i.e. when the SNR has low values strongly localized in time (e.g. speech pauses, soft phonemes strongly corrupted by the background noise), and/or the SNR is low in a particular estimation channel, i.e. when the SNR has low values strongly localized in frequency (e.g. some sub-band containing essentially noise but no speech energy).

The linearization is realized using estimated level post-processing. This functionality is termed the "Compression Relaxing" feature of SNRCA.

Gain Relaxing

This feature applies a (configured) reduction of the prescribed gain for very low SNR (i.e. noise only) environments. The reduction is realized using prescribed gain post-processing. This functionality is termed the "Gain Relaxing" feature of SNRCA.

In the present context, the target signal is taken to be a signal intended to be listened to by the user. In an embodiment, the target signal is a speech signal. In the present context, the noise signal is taken to comprise signals from one or more signal sources not intended to be listened to by the user. In an embodiment, the one or more signal sources not intended to be listened to by the user comprises voice and/or non-voice signal sources, e.g. artificially or naturally generated sound sources, e.g. traffic noise, wind noise, babble (an unintelligible mixture of different voices), etc.

The hearing devices comprises a forward path comprising the electric signal path from the input unit to the output unit including the forward gain unit (gain application unit) and possible further signal processing units.

In an embodiment, the hearing device, e.g. the control unit, is adapted to provide that classification of the electric input signal is indicative of a current acoustic environment of the user. In an embodiment, the control unit is configured to classify the acoustic environment in a number of different classes, said number of different classes e.g. comprising one or more of speech in noise, speech in quiet, noise, and clean speech. In an embodiment, the control unit is configured to classify noise as loud noise or soft noise.

In an embodiment, the control unit is configured to provide the classification according to (or based on) a current mixture of target signal and noise signal components in the electric input signal or a processed version thereof.

In an embodiment, the hearing device comprises a voice activity detector for identifying time segments of an electric input signal comprising speech and time segments comprising no speech, or comprises speech or no speech with a certain probability, and providing a voice activity signal indicative thereof. In an embodiment, the voice activity detector is configured to provide the voice activity signal in a number of frequency sub-bands. In an embodiment, the voice activity detector is configured to provide that the voice activity signal is indicative of a speech absence likelihood.

In an embodiment, the control unit is configured to provide the classification in dependence of a current target signal to noise signal ratio. In the present context, a signal to noise ratio (SNR), at a given instance in time, is taken to include a ratio of an estimated target signal component and an estimated noise signal component of an electric input signal representing audio, e.g. sound from the environment of a user wearing the hearing device. In an embodiment, the signal to noise ratio is based on a ratio of estimated levels or power or energy of said target and noise signal components. In an embodiment, the signal to noise ratio is an a priori signal to noise ratio based on a ratio of a level or power or energy of a noisy input signal to an estimated level or power or energy of the noise signal component. In an embodiment, the signal to noise ratio is based on broadband signal component estimates (e.g. in the time domain, SNR=SNR (t), where t is time). In an embodiment, the signal to noise ratio is based on sub-band signal component estimates (e.g. in the time-frequency domain, SNR=SNR (t,f), where t is time and f is frequency).

In an embodiment, the hearing device is adapted to provide that the electric input signal can be received or provided as a number of frequency sub-band signals. In an embodiment, the hearing device (e.g. the input unit) comprises an analysis filter bank for providing said electric input signal as a number of frequency sub-band signals. In an embodiment, the hearing device (e.g. the output unit) comprises a synthesis filter bank for providing an electric output signal in the time domain from a number of frequency sub-band signals.

In an embodiment, the hearing device comprises a memory wherein said hearing data of the user or data or algorithms derived therefrom are stored. In an embodiment, the user's hearing data comprises data characterizing a user's hearing impairment (e.g. a deviation from a normal hearing ability). In an embodiment, the hearing data comprises the user's frequency dependent hearing threshold levels. In an embodiment, the hearing data comprises the user's frequency dependent uncomfortable levels. In an embodiment, the hearing data includes a representation of the user's frequency dependent dynamic range of levels between a hearing threshold and an uncomfortable level.

In an embodiment, the level compression unit is configured to determine said compressive amplification gain according to a fitting algorithm. In an embodiment, the fitting algorithm is a standardized fitting algorithm. In an embodiment, the fitting algorithm is based on a generic (e.g. NAL-NL1 or NAL-NL2 or DSLm[i/o] 5.0) or a predefined proprietary fitting algorithm. In an embodiment, the hearing data of the user or data or algorithms derived therefrom comprises user specific level and frequency dependent gains. Based thereon, the level compression unit is configured to provide an appropriate (frequency and level dependent) gain for a given (modified) level of the electric input signal (at a given time).

In an embodiment, the level detector unit is configured to provide an estimate of a level of an envelope of the electric input signal. In an embodiment, the classification of the electric input signal comprises an indication of a current or average level of an envelope of the electric input signal. In an embodiment, the level detector unit is configured to determine a top tracker and a bottom tracker (envelope) from which a noise floor and a modulation index can be derived. A level detector which can be used as or form part of the level detector unit is e.g. described in WO2003081947A1.

In an embodiment, the hearing device comprises first and second level estimators configured to provide first and second estimates of the level of the electric input signal, respectively, the first and second estimates of the level being determined using first and second time constants, respectively, wherein the first time constant is smaller than the second time constant. In other words, the first and second level estimators correspond to fast and slow level estimators, respectively, providing fast and slow level estimates, respectively. In an embodiment, the first level estimator is configured to track the instantaneous level of the envelope of the electric input signal (e.g. comprising speech) (or a processed version thereof). In an embodiment, the second level estimator is configured to track an average level of the envelope of the electric input signal (or a processed version thereof). In an embodiment, the first and/or the second level estimates is/are provided in frequency sub-bands.

In an embodiment, the control unit is configured to determine first and second signal to noise ratios of the electric input signal or a processed version thereof, wherein said first and second signal-to-noise ratios are termed local SNR and global SNR, respectively, and wherein the local SNR denotes a relatively short-time ($\tau_L$) and sub-band specific ($\Delta f_L$) signal-to-noise ratio and wherein the global SNR denotes a relatively long-time ($\tau_G$) and broad-band ($\Delta f_G$) signal to noise ratio, and wherein the time constant $\tau_G$ and frequency range $\Delta f_G$ involved in determining the global SNR are larger than corresponding time constant $\tau_L$ and frequency range $\Delta f_L$ involved in determining the local SNR. In an embodiment, $\tau_L$ is much smaller than $\tau_G$ ($\tau_L \ll \tau_G$). In an embodiment, $\Delta f_L$ is much smaller than $\Delta f_G$ ($\Delta f_L \ll \Delta f_G$).

In an embodiment, the control unit is configured to determine said first and/or said second control signals based on said first and/or second signal to noise ratios of said electric input signal or a processed version thereof. In an embodiment, the control unit is configured to determine said first and/or said second signal to noise ratios using said first and second level estimates, respectively. The first, 'fast' signal-to-noise ratio is termed the local SNR. The second, 'slow' signal-to-noise ratio is termed the global SNR. In an embodiment, the first, 'fast', local, signal-to-noise ratio is frequency sub-band specific. In an embodiment, the second, 'slow', global, signal-to-noise ratio is based on a broadband signal.

In an embodiment, the control unit is configured to determine the first control signal based on said first and second signal to noise ratios. In an embodiment, the control unit is configured to determine the first control signal based on a comparison of the first (local) and second (global) signal to noise ratios. In an embodiment, the control unit is configured to increase the level estimate for decreasing first SNR-values if the first SNR-values are smaller than the second SNR-values. In an embodiment, the control unit is configured to decrease the level estimate for increasing first SNR-values if the first SNR-values are smaller than the second SNR-values. In an embodiment, the control unit is configured not to modify the level estimate for first SNR-values larger than the second SNR-values.

In an embodiment, the control unit is configured to determine the second control signal based on a smoothed signal to noise ratio of said electric input signal or a processed version thereof. In an embodiment, the control unit is configured to determine the second control signal based on the second (global) signal to noise ratio.

In an embodiment, the control unit is configured to determine the second control signal in dependence of said voice activity signal. In an embodiment, the control unit is configured to determine the second control signal based on the second (global) signal to noise ratio, when the voice activity signal is indicative of a speech absence likelihood.

In an embodiment, the hearing device comprises a hearing aid (e.g. a hearing instrument, e.g. a hearing instrument adapted for being located at the ear or fully or partially in the ear canal of a user, or for being fully or partially implanted in the head of a user), a headset, an earphone, an ear protection device or a combination thereof.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the electric input signal and providing a processed output signal, e.g. including a compensation for a hearing impairment of a user.

The hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. In an embodiment, the hearing device comprises a directional microphone system (e.g. comprising a beamformer filtering unit) adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation). In an embodiment, the wireless link is based on a standardized or proprietary technology. In an embodiment, the wireless link is based on Bluetooth technology (e.g. Bluetooth Low-Energy technology).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n)), each audio sample representing the value of the acoustic signal at $t_n$ by a predefined number $N_b$ of bits, $N_b$ being e.g. in the range from 1 to 48 bits, e.g. 24 bits. A digital sample x has a length in time of $1/f_s$, e.g. 50 μs, for $f_s$=20 [kHz]. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number M of frequency bands, where M is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number Q of different frequency channels ($M \leq Q$). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, acoustic feedback, etc.), and c) the current mode or state of the user (movement, temperature, activity, etc.);

d) the current mode or state of the hearing device (program selected, time elapsed since last user interaction, etc.) and/or of another device in communication with the hearing device.

In an embodiment, the hearing device further comprises other relevant functionality for the application in question, e.g. feedback suppression, etc.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device, e.g. a hearing aid, is provided. The method comprises receiving or providing an electric input signal with a first dynamic range of levels representative of a time and frequency variant sound signal, the electric input signal comprising a target signal and/or a noise signal;

providing a level estimate of said electric input signal;

providing a modified level estimate of said electric input signal in dependence of a first control signal;

providing a compressive amplification gain in dependence of said modified level estimate and hearing data representative of a user's hearing ability;

providing a modified compressive amplification gain in dependence of a second control signal;

analysing said electric input signal to provide a classification of said electric input signal, and providing said first and second control signals based on said classification;

applying said modified compressive amplification gain to said electric input signal or a processed version thereof; and providing output stimuli perceivable by a user as sound representative of said electric input signal or a processed version thereof.

It is intended that some or all of the structural features of the hearing device described above, in the 'detailed description of embodiments' or in the claims can be combined with embodiments of the method, when appropriately substituted by a corresponding process and vice versa. Embodiments of the method have the same advantages as the corresponding hearing devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

An App:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on a cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output unit for providing an audible signal to the user in dependence on the processed audio signal. The signal processing unit may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear fluids, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex and associated structures.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain may be determined in a fitting process by a fitting system based on a user's hearing data, e.g. an audiogram, using a generic or proprietary fitting rationale. The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, hands free telephone systems, car audio systems, entertainment (e.g. karaoke) systems, teleconferencing systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out for the sake of brevity. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are intentionally left out. Throughout, the same reference signs are used for identical or corresponding parts.

Figure 1:
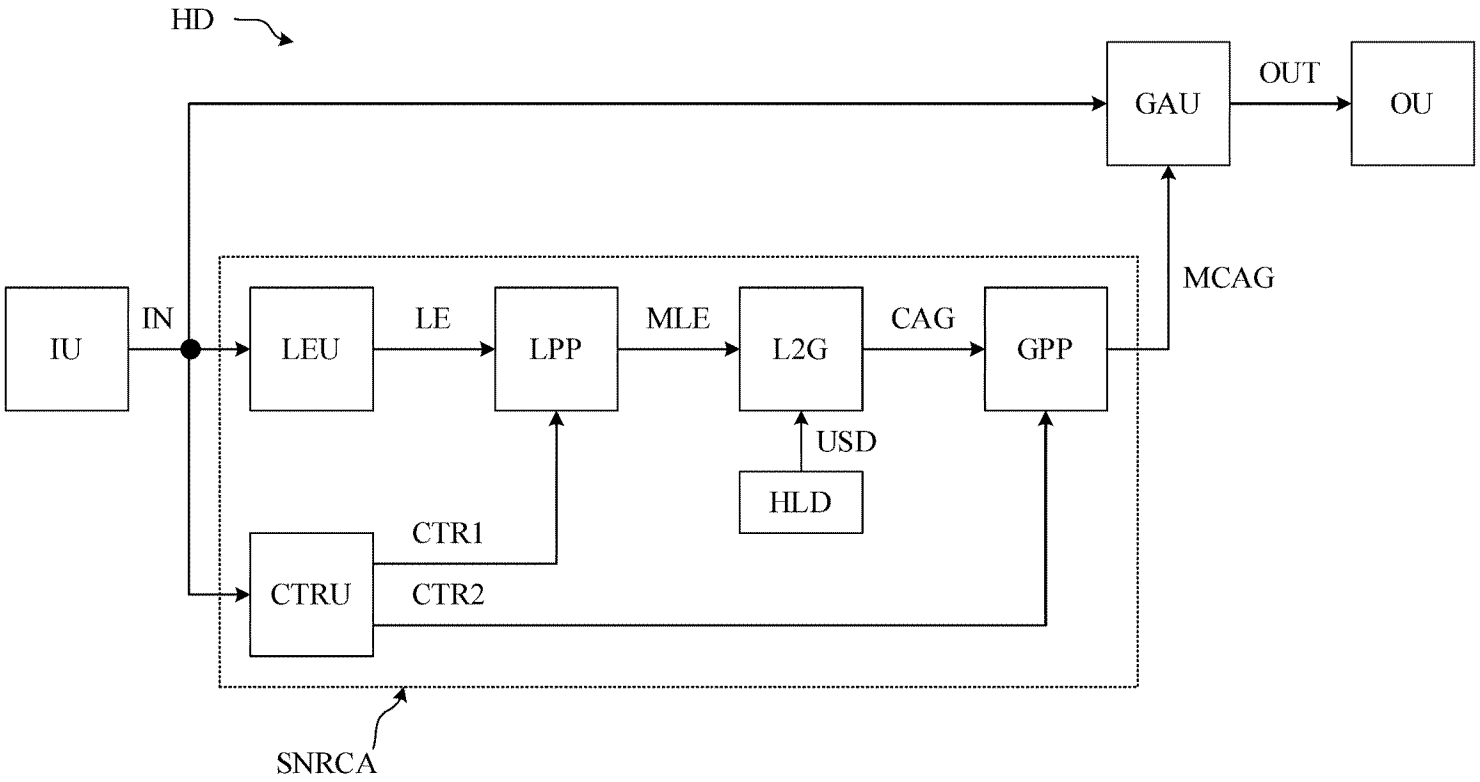
FIG. 1 shows an embodiment of a hearing device according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. The term 'computer program' shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

In the following, the concept of compressive amplification (CA) is outlined in an attempt to highlight the problems that the SNR driven compressive amplification system (SNRCA) of the present disclosure addresses.

Compressive amplification (CA) is designed and used to restore speech audibility.

With x[n] the signal at the input of the compressor (i.e. CA scheme), e.g. the electric input signal (time domain), n the sampled time index, one can write x[n] as the sum of the M sub-bands signals $x_m[n]$:

$$x[n] = \sum_{m=0}^{M-1} x_m[n]$$

Each of the M sub-bands can be used as a level estimation channel, and produce $l_{m,\tau}[n]$, an estimate of the power level $P_{x_m,\tau}[n]$ that is obtained by (typically square) rectification followed by (potentially non-linear and time varying) low-pass filtering (smoothing operation). The strength of low-pass filtering operator $H_m$ is defined by the desired level estimation time constant $\tau$. E.g. for square rectification:

$$l_{m,\tau}[n]=H_m(|x_m[n]|^2,n,\tau)$$

Using the compression characteristic curve, i.e. a function that maps the level of each channel $l_m$ to a channel gain $g_m(l_m)$, the compressor computes, for each estimated level $l_{m,\tau}[n]$, a gain $g_m[n]=g_m(l_{m,\tau}[n])$ that can be applied on $x_m[n]$ to produce the amplified mth sub-band $y_m[n]$:

$$y_m[n]=g_m[n]x_m[n]$$

The gain $g_m[n]$ is a function of the estimated input level $l_{m,\tau}[n]$, i.e. $g_m[n]=g_m(l_{m,\tau}[n])$, under the following constraints: For the two estimated level $l_{soft}$ and $l_{loud}$ with $$l_{soft}<l_{loud}$$

The corresponding gains $g_{soft}=g(l_{soft})$ and $g_{loud}=g(l_{loud})$ satisfy:

$$g_{soft}\geq g_{loud}$$

However, the compression ratio shall not be negative, so the following condition is always satisfied:

$$l_{soft}g_{soft}\leq l_{loud}g_{loud}$$

The compressor output signal y[n] can be reconstructed as follows:

$$y[n]=\sum_{m=0}^{M-1} y_m[n]=\sum_{m=0}^{M-1} g_m[n]x_m[n]$$

However, applied to noisy signals, CA tends to degrade the SNR, behaving as a noise amplifier (see next section for more details). In other words, $SNR_O$ the SNR at the output of the compressor is potentially smaller than $SNR_I$ the SNR at the input of the compressor:

$$SNR_O\leq SNR_I$$

1. Compressive Amplification and SNR Degradation:

Depending on the long-term broadband SNR at the compressor input, classical CA can (in certain acoustic situations) be counter-productive in terms of SNR as mentioned above. Before going more in details into this in the next sub-sections, please find some definitions in the following:

Time Constants $\tau_L$ and $\tau_G$ are averaging time constants satisfying $$\tau_L\leq\tau_G$$

$\tau_L$ represents a relative short time: Its magnitude order typically corresponds to the length of a phoneme or a syllable (i.e. 1 to less than 100 ms.).

$\tau_G$ represents a relative long time: Its magnitude order typically corresponds to the length of one two several words or even sentences (i.e. 0.5 s to more than 5 s).

Usually, the difference in magnitude order between $\tau_L$ and $\tau_G$ is large, i.e.

$$\tau_L<<\tau_G$$

e.g. $\tau_L\leq 10\tau_G$.

Bandwidths $\Delta f_L$ and $\Delta f_G$ are bandwidths satisfying $$\Delta f_L\leq\Delta f_G$$

$\Delta f_L$ represents a relative narrow bandwidth. It is typically the bandwidth used in auditory filter banks, i.e. from several Hertz to several kHz.

$\Delta f_G$ represents the full bandwidth of the processed signal. It is defined as half the sampling frequency $f_s$, i.e. $\Delta f_G=f_s/2$. In current HA, it is typically between 8 to 16 kHz.

Usually, the difference in magnitude order between $\Delta f_L$ and $\Delta f_G$ is large, i.e.

$$\Delta f_L<<\Delta f_G$$

e.g. $\Delta f_L\leq 10\Delta f_G$.

Input and Output Signals

The input signal of the compressor, e.g. the electric input signal (CA scheme), is denoted x[n], where n is the sampled time index.

The output signal of the compressor (CA scheme) is denoted y[n].

Both x and y are broadband signals, i.e. they use the full bandwidth $\Delta f_G$.

$x_m[n]$ is the mth of the M sub-bands of the input signal x[n]. Its bandwidth $\Delta f_{L,m}$ is smaller than $\Delta f_G$: compared to x, $x_m$ is localized in frequency.

$y_m[n]$ is the mth of the M sub-bands of the output signal y[n]. Its bandwidth $\Delta f_{L,m}$ is smaller than $\Delta f_G$: compared to y, $y_m$ is localized in frequency.

Note that if the filter bank that splits x into the M sub-bands $x_m$ is uniform, then $\Delta f_{L,m}=\Delta f_L$ for all m. In the rest of this text, we assume the usage of constants bandwidth sub-bands, i.e. $\Delta f_{L,m}=\Delta f_L$, without loss of generality: Assuming the signal is split into M' sub-bands with non-constant bandwidth $\Delta f_{L,m'}$, one can select a bandwidth $\Delta f_{L,m}=\Delta f_L$ that is the greatest common divisor of bandwidth $\Delta f_{L,m'}$, i.e. $\Delta f_{L,m'}=C_{m'}\Delta f_L$ with $C_{m'}$ a strictly positive integer for all m'. The new number of sub-bands is $$M=\sum_{m'=0}^{M'-1} C_{m'}\geq M'$$

Level estimation in sub-bands in the gain application can be emulated:

$$l_{m'}[n]=\frac{1}{C_{m'}}\sum_{m=C_{m'-1}}^{C_{m'}-1} l_m[n]$$

Gain application in larger sub-bands can be emulated:

$$y_{m'}[n]=\sum_{m=C_{m'-1}}^{C_{m'}-1} y_m[n]$$

The broadband input signal segment $\bar{x}_{\tau_G}=\{x[n], \ldots, x[n+K_G-1]\}^T$ with $\tau_G=K_G/f_s$ is not localized in time nor in frequency, because it represents a broadband long-time segment.

The broadband output signal segment $\bar{y}_{\tau_G}=\{y[n], \ldots, y[n+K_G-1]\}^T$ with $\tau_G=K_G/f_s$ is not localized in time nor in frequency, because it represents a broadband long-time segment.

The broadband input signal segment $\bar{x}_{\tau_L}=\{x[n], \ldots, x[n+K_L-1]\}^T$ with $\tau_L=K_L/f_s$ is localized in time but not in frequency, because is represent a broadband short-time segment. The sub-band input signal segment $\bar{x}_{m,\tau_G}=\{x_m[n], \ldots, x_m[n+K_G-1]\}^T$ with $\tau_G=K_G/f_s$ is localized in frequency but not in time, because it represents a sub-band long-time segment. The sub-band output signal segment $\bar{y}_{m,\tau_G}=\{y_m[n], \ldots, y_m[n+K_G-1]\}^T$ with $\tau_G=K_G/f_s$ is localized in frequency but not in time, because is represent a sub-band long-time segment. The broadband output signal segment $\bar{y}_{\tau_L}=\{y[n], \ldots, y[n+K_L-1]\}^T$ with $\tau_L=K_L/f_s$ is localized in time but not in frequency, because it represents a broadband short-time segment. The sub-band input signal segment $\bar{x}_{m,\tau_L}=\{x_m[n], \ldots, x_m[n+K_L-1]\}^T$ with $\tau_L=K_L/f_s$ is localized both in time and frequency, because it represents a sub-band short-time segment. The sub-band output signal segment $\bar{y}_{m,\tau_L}=\{y_m[n], \ldots, y_m[n+K_L-1]\}^T$ with $\tau_L=K_L/f_s$ is localized both in time and frequency, because it represents a sub-band short-time segment.

Additive Noise Model

The broadband input signal x[n] can be modelled as the sum of the broadband input speech signal s[n] and the broadband input noise (disturbance) d[n]:

$$x[n]=s[n]+d[n]$$

The sub-band input signal $x_m[n]$ can be modelled as the sum of the input sub-band speech signal $s_m[n]$ and the input sub-band noise (disturbance) $d_m[n]$:

$$x_m[n]=s_m[n]+d_m[n]$$

The broadband output signal y[n] can be modelled as the sum of the broadband output speech signal $y_s[n]$ and the broadband output noise (disturbance) $y_d[n]$:

$$y[n]=y_s[n]+y_d[n]$$

The sub-band output signal $y_m[n]$ can be modelled as the sum of the output sub-band speech signal $y_{s_m}[n]$ and the broadband output noise (disturbance) $y_{d_m}[n]$:

$$y_m[n]=y_{s_m}[n]+y_{d_m}[n]$$

Input Power $P_{x_m,\tau_L}$ is the average sub-band input signal power over a time $\tau_L=K_L/f_s$ $$P_{x_m,\tau_L}[n]=\frac{f_s}{K_L}\sum_{k=0}^{K_L-1}x_m^2[n+k]$$

Note that in CA, the level estimation stage provide an estimate $l_{m,\tau_L}[n]$ for $P_{x_m,\tau_L}[n]$, i.e.

$$l_{m,\tau_L}[n]=\hat{P}_{x_m,\tau_L}[n]$$

$P_{s_m,\tau_L}$ is the average sub-band input speech power over a time $\tau_L=K_L/f_s$ $$P_{s_m,\tau_L}[n]=\frac{f_s}{K_L}\sum_{k=0}^{K_L-1}s_m^2[n+k]$$

$P_{d_m,\tau_L}$ is the average sub-band input noise power over a time $\tau_L K_L/f_s$ $$P_{d_m,\tau_L}[n]=\frac{f_s}{K_L}\sum_{k=0}^{K_L-1}d_m^2[n+k]$$

Note that in SNRCA, a noise power estimator is used to provide an estimate $l_{d_m,\tau_L}[n]$ for the noise power $P_{d_m,\tau_L}[n]$, i.e.

$$l_{d_m,\tau_L}[n]=\hat{P}_{d_m,\tau_L}[n]$$

Note also that $P_{x_m,\tau_L}=P_{s_m+d_m,\tau_L}\leq P_{s_m,\tau_L}+P_{d_m,\tau_L}$. (Cauchy-Schwarz inequality), with equality holding only if $s_m$ and $d_m$ are orthogonal (uncorrelated and zero mean).

$P_{x,\tau_L}$ is the average broadband input signal power over a time $\tau_L=K_L/f_s$ $$P_{x,\tau_L}[n]=\frac{f_s}{K_L}\sum_{k=0}^{K_L-1}x^2[n+k]=\frac{1}{M}\sum_{m=0}^{M-1}P_{x_m,\tau_L}[n]$$

$P_{s,\tau_L}$ is the average broadband input speech power over a time $\tau_L=K_L/f_s$ $$P_{s,\tau_L}[n]=\frac{f_s}{K_L}\sum_{k=0}^{K_L-1}s^2[n+k]=\frac{1}{M}\sum_{m=0}^{M-1}P_{s_m,\tau_L}[n]$$

$P_{d,\tau_L}$ is the average broadband input noise power over a time $\tau_L=K_L/f_s$ $$P_{d,\tau_L}[n]=\frac{f_s}{K_L}\sum_{k=0}^{K_L-1}d^2[n+k]=\frac{1}{M}\sum_{m=0}^{M-1}P_{d_m,\tau_L}[n]$$

Note that $P_{x,\tau_L}=P_{s+d,\tau_L}\leq P_{s,\tau_L}+P_{d,\tau_L}$ (Cauchy-Schwarz inequality), with equality holding only if s and d are orthogonal (uncorrelated and zero mean).

$P_x=P_{x,\tau_G}$ is the average broadband input signal power over a time $\tau_G=K\tau_L=KK_L/f_s=K_G/f_s$ and with $\Delta f_G=M\Delta f_L$ $$P_{x,\tau_G}[n]=\frac{1}{K}\sum_{k=0}^{K-1}P_{x,\tau_L}[n+kK_L]=\frac{1}{KM}\sum_{k=0}^{K-1}\sum_{m=0}^{M-1}P_{x_m,\tau_L}[n+kK_L]=\frac{f_s}{K_GM}\sum_{k=0}^{K_G-1}\sum_{m=0}^{M-1}x_m^2[n+k]=\frac{1}{M}\sum_{m=0}^{M-1}P_{x_m,\tau_G}[n]$$

$P_s=P_{s,\tau_G}$ is the average broadband input speech power over a time $\tau_G=K\tau_L=KK_L/f_s=K_G/f_s$ and with $\Delta f_G=M\Delta f_L$ $$P_{s,\tau_G}[n]=\frac{1}{K}\sum_{k=0}^{K-1}P_{s,\tau_L}[n+kK_L]=\frac{1}{KM}\sum_{k=0}^{K-1}\sum_{m=0}^{M-1}P_{s_m,\tau_L}[n+kK_L]=\frac{f_s}{K_GM}\sum_{k=0}^{K_G-1}\sum_{m=0}^{M-1}s_m^2[n+k]=\frac{1}{M}\sum_{m=0}^{M-1}P_{s_m,\tau_G}[n]$$

$P_d=P_{d,\tau_G}$ is the average broadband input noise power over a time $\tau_G=K\tau_L=KK_L/f_s=K_G/f_s$ and with $\Delta f_G=M\Delta f_L$ $$P_{d,\tau_G}[n]=\frac{1}{K}\sum_{k=0}^{K-1}P_{d,\tau_L}[n+kK_L]=\frac{1}{KM}\sum_{k=0}^{K-1}\sum_{m=0}^{M-1}P_{d_m,\tau_L}[n+kK_L]=\frac{f_s}{K_GM}\sum_{k=0}^{K_G-1}\sum_{m=0}^{M-1}d_m^2[n+k]=\frac{1}{M}\sum_{m=0}^{M-1}P_{d_m,\tau_G}[n]$$

Note that $P_{x,\tau_G}=P_{s+d,\tau_G}\leq P_{s,\tau_G}+P_{d,\tau_G}$ (Cauchy-Schwarz inequality), with equality holding only if s and d are orthogonal (uncorrelated and zero mean).

Output Power $$P_{y_m,\tau_L}$$

is the average sub-band output signal power over a time $\tau_L=K_L/f_s$ $$P_{y_m,\tau_L}[n]=\frac{f_s}{K_L}\sum_{k=0}^{K_L-1} y_m^2[n+k]$$

$$P_{y_{s_m},\tau_L}$$

is the average sub-band input speech power over a time $\tau_L=K_L/f_s$ $$P_{y_{s_m},\tau_L}[n]=\frac{f_s}{K_L}\sum_{k=0}^{K_L-1} y_{s_m}^2[n+k]$$

$$P_{y_{d_m},\tau_L}$$

is the average sub-band output noise power over a time $\tau_L=K_L/f_s$ $$P_{y_{d_m},\tau_L}[n]=\frac{f_s}{K_L}\sum_{k=0}^{K_L-1} y_{d_m}^2[n+k]$$

$P_{y,\tau_L}$ is the average broadband output signal power over a time $\tau_L=K_L/f_s$ $$P_{y,\tau_L}[n]=\frac{f_s}{K_L}\sum_{k=0}^{K_L-1} y^2[n+k]=\frac{1}{M}\sum_{m=0}^{M-1} P_{y_m,\tau_L}[n]$$

$P_{y_s,\tau_L}$ is the average broadband output speech power over a time $\tau_L=K_L/f_s$ $$P_{y_s,\tau_L}[n]=\frac{f_s}{K_L}\sum_{k=0}^{K_L-1} y_s^2[n+k]=\frac{1}{M}\sum_{m=0}^{M-1} P_{y_{s_m},\tau_L}[n]$$

$P_{y_d,\tau_L}$ is the average broadband output noise power over a time $\tau_L=K_L/f_s$ $$P_{y_d,\tau_L}[n]=\frac{f_s}{K_L}\sum_{k=0}^{K_L-1} y_d^2[n+k]=\frac{1}{M}\sum_{m=0}^{M-1} P_{y_{d_m},\tau_L}[n]$$

$P_y=P_{y,\tau_G}$ is the average broadband output signal power over a time $\tau_G=K\tau_L=KK_L/f_s=K_G/f_s$ and with $\Delta f_G=M\Delta f_L$ $$P_{y,\tau_G}[n]=\frac{1}{K}\sum_{k=0}^{K-1} P_{y,\tau_L}[n+kK_L]=\frac{1}{KM}\sum_{k=0}^{K-1}\sum_{m=0}^{M-1} P_{y_m,\tau_L}[n+kK_L]=\frac{f_s}{K_GM}\sum_{k=0}^{K_G-1}\sum_{m=0}^{M-1} y_m^2[n+k]=\frac{1}{M}\sum_{m=0}^{M-1} P_{y_m,\tau_G}[n]$$

$P_{y_s}=P_{y_s,\tau_G}$ is the average broadband output speech power over a time $\tau=K\tau_L=KK_L/f_s=K/f_s$ and with $\Delta f_G=M\Delta f_L$ $$P_{y_s,\tau_G}[n]=\frac{1}{K}\sum_{k=0}^{K-1} P_{y_s,\tau_L}[n+kK_L]=\frac{1}{KM}\sum_{k=0}^{K-1}\sum_{m=0}^{M-1} P_{y_{s_m},\tau_L}[n+kK_L]=\frac{f_s}{K_GM}\sum_{k=0}^{K_G-1}\sum_{m=0}^{M-1} y_{s_m}^2[n+k]=\frac{1}{M}\sum_{m=0}^{M-1} P_{y_{s_m},\tau_G}[n]$$

$P_{y_d}=P_{y_d,\tau_G}$ is the average broadband output noise power over a time $\tau_G=K\tau_L=KK_L/f_s=K_G/f_s$ and with $\Delta f=M\Delta f_L$ $$P_{y_d,\tau_G}[n]=\frac{1}{K}\sum_{k=0}^{K-1} P_{y_d,\tau_L}[n+kK_L]=\frac{1}{KM}\sum_{k=0}^{K-1}\sum_{m=0}^{M-1} P_{y_{d_m},\tau_L}[n+kK_L]=\frac{f_s}{K_GM}\sum_{k=0}^{K_G-1}\sum_{m=0}^{M-1} d_{s_m}^2[n+k]=\frac{1}{M}\sum_{m=0}^{M-1} P_{y_{d_m},\tau_G}[n]$$

Input SNR $SNR_{I,m,\tau_L}$ is the average sub-band input SNR over a time $\tau_L=K_L/f_s$ $$SNR_{I,m,\tau_L}=P_{s_m,\tau_L}/P_{d_m,\tau_L}$$

$SNR_{I,\tau_L}$ is the average broadband input SNR over a time $\tau_L=K_L/f_s$ $$SNR_{I,\tau_L}=P_{s,\tau_L}/P_{d,\tau_L}$$

$SNR_{I,m,\tau_G}$ is the average sub-band input SNR over a time $\tau_G=K_G/f_s$ $$SNR_{I,m,\tau_G}=P_{s_m,\tau_G}/P_{d_m,\tau_G}$$

$SNR_I=SNR_{I,\tau_G}$ is the average broadband input SNR over a time $\tau_G=K_G/f_s$ $$SNR_{I,\tau_G}=P_{s,\tau_G}/P_{d,\tau_G}$$

Output SNR $SNR_{O,m,\tau_L}$ is the average sub-band output SNR over a time $\tau_L=K_L/f_s$ $$SNR_{O,m,\tau_L}=P_{y_{s_m},\tau_L}/P_{y_{d_m},\tau_L}$$

$SNR_{O,\tau_L}$ is the average broadband output SNR over a time $\tau_L=K_L/f_s$ $$SNR_{O,\tau_L}=P_{y_s,\tau_L}/P_{y_d,\tau_L}$$

$SNR_{O,m,\tau_G}$ is the average sub-band output SNR over a time $\tau_G=K_G/f_s$ $$SNR_{O,m,\tau_G}=P_{y_{s_m},\tau_G}/P_{y_{d_m},\tau_G}$$

$SNR_O = SNR_{O,\tau_G}$ is the average broadband output SNR over a time $\tau_G = K_G/f_s$ $$SNR_{O,\tau_G} = P_{y_s,\tau_G}/P_{y_d,\tau_G}$$

Global and Local SNR

The term 'input global SNR' or simply 'global SNR' denotes a signal to noise ratio computed on the broadband (i.e. full bandwidth $\Delta f_G$) input signal x of the compressor, and averaged over a relative long time $\tau_G$:

$$SNR(\bar{x}_{\tau_G}) = SNR_{I,\tau_G = SNR^I}$$

The term 'output global SNR' denotes a signal to noise ratio computed on the broadband (i.e. full bandwidth $\Delta f_G$) output signal y of the compressor, and averaged over a relative long time $\tau_G$:

$$SNR(\bar{y}_{\tau_G}) = SNR_{O,\tau_G} = SNR_O$$

The term 'input local SNR' or simply 'local SNR' denotes interchangeably, according to the context:

a signal to noise ratio computed on the broadband (i.e. full bandwidth $\Delta f_G$) input signal x of the compressor, and averaged over a relative short time $\tau_L$ $$SNR(\bar{x}_{\tau_L}) = SNR_{I,\tau_L}$$

or a signal to noise ratio computed on the sub-band (i.e. bandwidth $\Delta f_{L,m}$) input signal $x_m$ of the compressor, and averaged over a relative long time $\tau_G$ $$SNR(\bar{x}_{m,\tau_G}) = SNR_{I,m,\tau_G}$$

or a signal to noise ratio computed on the sub-band (i.e. bandwidth $\Delta f_L$) input signal $x_m$ of the compressor, and averaged over a relative short time $\tau_L$ $$SNR(\bar{x}_{m,\tau_L}) = SNR_{I,m,\tau_L}$$

The local SNR is denoted $SNR_L$ as long as, in the discussed context:

there is no ambiguity concerning which one of the 3 types is used, or $SNR_L$ can be replaced by any of the 3 types.

SNR and Modulated Temporal Envelope

Let be a the sum of two orthogonal signals u and v, i.e $$a = u + v$$

and $$P_{a,\tau_L} = P_{u,\tau_L} + P_{v,\tau_L}$$

Let u have a temporal envelope that is more modulated than the temporal envelope of v. This means that the variance $$\sigma^2_{P_{u,\tau_L}}$$

of $P_{u,\tau_L}$ is larger than the variance $$\sigma^2_{P_{v,\tau_L}}$$

of $P_{v,\tau_L}$, i.e.

$$\sigma^2_{P_{u,\tau_L}} \geq \sigma^2_{P_{v,\tau_L}}$$

With $$\sigma^2_{P_{u,\tau_L}} = E[(P_{u,\tau_L} - E[P_{u,\tau_L}])^2] = E\left[P^2_{u,\tau_L}\right] - E[P_{u,\tau_L}]^2$$

And $$\sigma^2_{P_{v,\tau_L}} = E[(P_{v,\tau_L} - E[P_{v,\tau_L}])^2] = E\left[P^2_{v,\tau_L}\right] - E[P_{v,\tau_L}]^2$$

The variances can be estimated as follows:

$$\hat{\sigma}^2_{P_{u,\tau_L}} = \hat{\sigma}^2_{P_{u,\tau_L}}[n] = \frac{1}{K}\sum_{k=0}^{K-1} P^2_{u,\tau_L}[n+k] - P^2_{u,\tau_G}[n]$$

Respectively $$\hat{\sigma}^2_{P_{v,\tau_L}} = \hat{\sigma}^2_{P_{v,\tau_L}}[n] = \frac{1}{K}\sum_{k=0}^{K-1} P^2_{v,\tau_L}[n+k] - P^2_{v,\tau_G}[n]$$

Let u have a long term power larger than v, i.e.

$$P_{u,\tau_G} \geq P_{v,\tau_G}$$

Figure 9A:
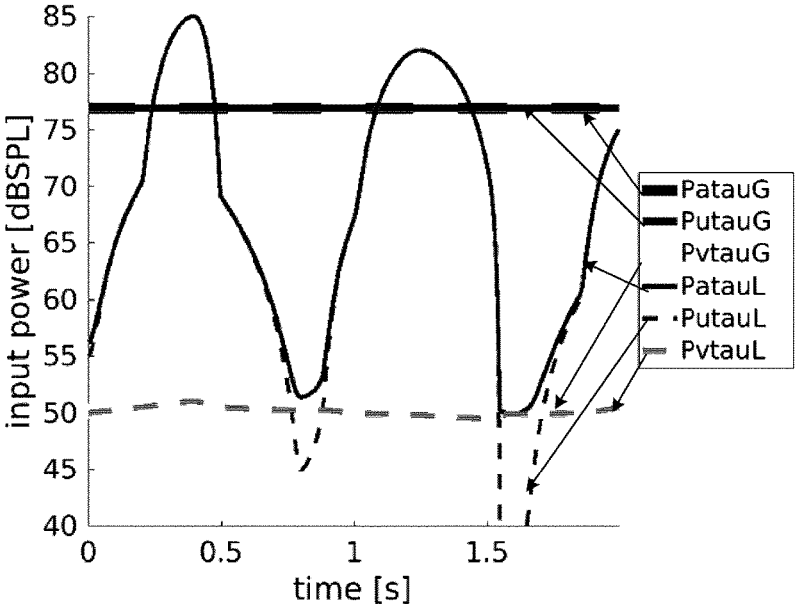
FIG. 9A shows the short and long term power of the temporal envelope of a strongly modulated time domain signal, a weakly time domain modulated signal and the sum of these two signals at the input of a CA system.

The situation is illustrated by an example on FIG. 9A, where signals $P_{u,\tau_L}$, $P_{v,\tau_L}$, $P_{a,\tau_L}$, $P_{u,\tau_G}$, $P_{v,\tau_G}$ and $P_{a,\tau_G}$ are labelled PutauL, PvtauL, PatauL, PutauG, PvtauG and PatauG respectively.

$P_{v,\tau_L}$ is relatively stable while $P_{u,\tau_L}$ is strongly modulated. On the peaks of the temporal envelope (approximately 0.4 s and 1.25 s) the total power $P_{a,\tau_L}$ is dominated by $P_{u,\tau_L}$:

$$P_{a,\tau_L} \rightarrow P_{u,\tau_L}{}^{+}$$

Because $$P_{u,\tau_L} >> P_{v,\tau_L}$$

On the other hand, in the modulated envelope valleys (approximately 0.6 s and 1.6 s) the total power $P_{a,\tau_L}$ is essentially made of $P_{v,\tau_L}$ only:

$$P_{a,\tau_L} \rightarrow P_{v,\tau_L}{}^{+}$$

Because $$P_{u,\tau_L} \rightarrow 0^{+}$$

Let b be the output of CA with a as input, with $b_u$ and $b_v$ the compressed counterpart of u and v respectively:

$$b = b_u + b_v$$

Figure 9B:
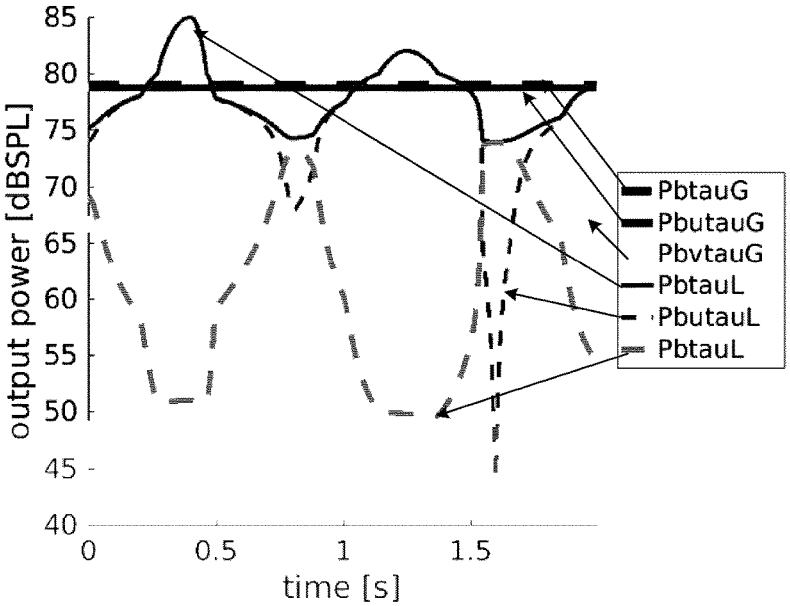
FIG. 9B shows the short and long term power of the temporal envelope of a strongly modulated time domain signal, a weakly modulated time domain signal and the sum of these two signals at the output of a CA system.

$P_{b_u,\tau_L}$, $P_{b_v,\tau_L}$, $P_{b,\tau_L}$, $P_{b_u,\tau_G}$, $P_{b_v,\tau_G}$ and $P_{b,\tau_G}$ (respectively labelled PbutauL, PbvtauL, PbtauL, PbutauG, PbvtauG and PbtauG on FIG. 9B) are their short and long term power respectively. FIG. 9A and FIG. 9B show that the strongly modulated signal u tends to get less gain in average than the weakly modulated signal v. Because of this, the long term output SNR $SNR_{O,\tau_G}$ might differ from the long term input SNR $SNR_{I,\tau_G}$.

If u represents the speech and v the noise (case 1a), the soundscape can be describe as follows:

$SNR_{I,\tau_G} \geq 0$ (positive long term input SNR): the long term power relationship between u and v is defined above with $P_{u,\tau_G} \geq P_{v,\tau_G}$. Speech is louder than noise.

$$\sigma^2_{P_{u,\tau_L}} \geq \sigma^2_{P_{v,\tau_L}}:$$

Speech is more modulated than steady state noise.

Figure 9C:
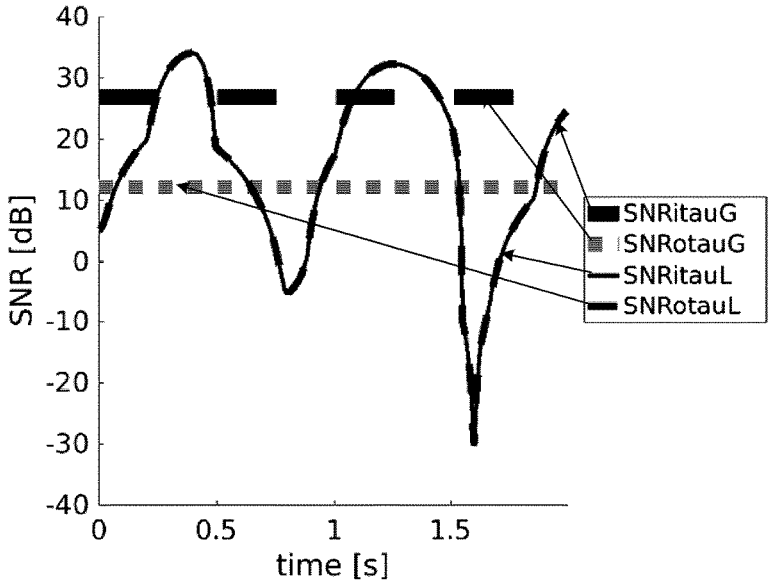
FIG. 9C shows the CA system input and output SNR if the weakly modulated time domain signal of FIG. 9A is the noise.

CA introduces an SNR degradation ($SNR_{I,\tau_G} \geq SNR_{O,\tau_G}$), as shown by FIG. 9C ($SNR_{I,\tau_L}$, $SNR_{I,\tau_G}$, $SNR_{O,\tau_L}$ and $SNR_{O,\tau_G}$ being labelled SNRitauL, SNRitauG, SNRotauL and SNRotauG respectively), because the short time segments that have the lowest SNR are the segments that have the lowest short time power $P_{a,\tau_L}$ and also receive the most gain.

Typical soundscape: speech in soft noise

Soundscape likelihood: High. a might typically be speech in relatively soft and unmodulated noise. E.g. offices, home, etc.

Soundscape relevance: High. At this kind of level, compressive amplification is applied, so the SNR might be degraded. Note that if the input SNR is extremely large (soundscape clean speech), i.e. $SNR_{I,\tau_G} \rightarrow +\infty$, then the output SNR is actually not degraded, i.e. $SNR_{O,\tau_G} \rightarrow +\infty$.

Note: This situation might happen to be broadband, i.e. if u=s, v=d, a=x, $b_u=y_u$, $b_v=y_v$ and, b=y or in some sub-band m, i.e. $u=s_m$, $v=d_m$, $a=x_m$, $b_u=y_{s_m}$, $b_v=y_{d_m}$ and, $b=y_m$.

If v represents the speech and u the noise (case 1b), the soundscape can be describe as follows:

$SNR_{I,\tau_G} \leq 0$ (negative long term input SNR): the long term power relationship between u and v is defined above with $P_{u,\tau_G} \geq P_{v,\tau_G}$. Noise is louder than speech.

$$\sigma^2_{P_{u,\tau_L}} \geq \sigma^2_{P_{v,\tau_L}}:$$

Speech is less modulated than noise.

Figure 9D:
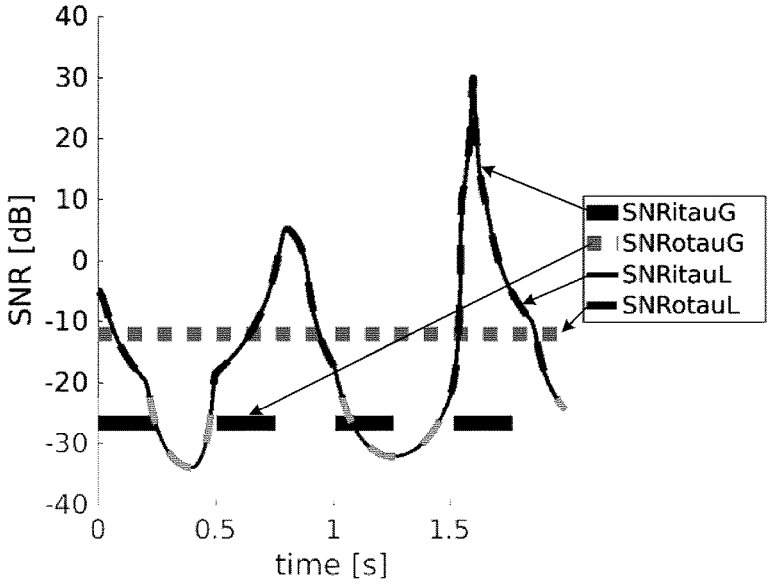
FIG. 9D shows the CA system input and output SNR if the strongly modulated time domain signal of FIG. 9A is the noise.

CA introduces an SNR improvement ($SNR_{I,\tau_G} \leq SNR_{O,\tau_G}$), as shown by FIG. 9D ($SNR_{I,\tau_L}$, $SNR_{I,\tau_G}$, $SNR_{O,\tau_L}$ and $SNR_{O,\tau_G}$ being labelled SNRitauL, SNRitauG, SNRotauL and SNRotauG respectively), because the short time segments that have the highest SNR are the segments that have the lowest short time power $P_{a,\tau_L}$ and by the way get the highest gain.

Typical soundscape: soft speech in medium/loud noise

Soundscape likelihood: Low. a might be a relative soft speech corrupted by loud and strongly modulated noise. Some specific loud noise might be modulated (e.g. jackhammer), however, we cannot expect HI users to spend much time in such soundscapes. Moreover, speech is generally much more modulated than v, so the SNR improvement might be negligible.

Soundscape relevance: Low. The loudness of this kind of noise sources is usually in a range where the amplification is linear and the gain close to 0 dB. Moreover, in modern HI, such loud and impulsive noise are usually attenuated using dedicated transient noise reduction algorithms.

Note: This situation might happen to be broadband, i.e. if u=s, v=d, a=x, $b_u=y_u$, $b_v=y_v$ and, b=y or in some sub-band m, i.e. $u=s_m$, $v=d_m$, $a=x_m$, $b_u=y_{s_m}$, $b_v=y_{d_m}$ and, $b=y_m$.

Let u have a long term power smaller than v, i.e.

$$P_{u,\tau_G} \leq P_{v,\tau_G}$$

Figure 9E:
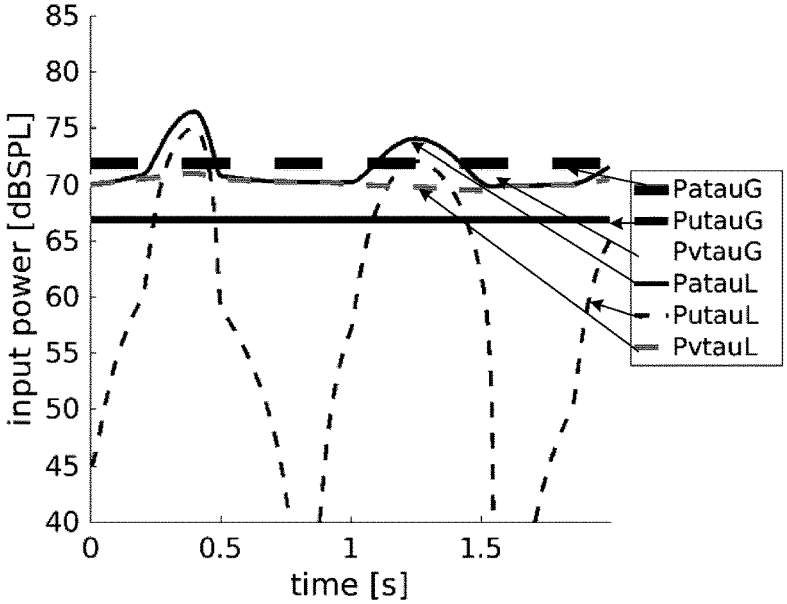
FIG. 9E shows the short and long term power of the temporal envelope of a strongly modulated time domain signal, a weakly modulated time domain signal and the sum of these two signals at the input of a CA system.

The situation is illustrated by an example on FIG. 9E, where signals $P_{u,\tau_L}$, $P_{v,\tau_L}$, $P_{a,\tau_L}$, $P_{u,\tau_G}$, $P_{v,\tau_G}$ and $P_{a,\tau_G}$ are labelled PutauL, PvtauL, PatauL, PutauG, PvtauG and PatauG respectively.

$P_{v,\tau_L}$ is relatively stable while $P_{u,\tau_L}$ is strongly modulated. Because v has more power than u, the temporal envelope of a is nearly as flat as the temporal envelope of v. In general, the total power $P_{a,\tau_L}$ is dominated by $P_{v,\tau_L}$, i.e.

$$P_{a,\tau_L} \rightarrow P_{v,\tau_L}^+$$

excepted on the peaks of the temporal envelope (approximately 0.4 s and 1.25 s) where $P_{u,\tau_L}$ is not negligible, i.e.:

$$P_{u,\tau_L} \approx P_{v,\tau_L}$$

Or even $$P_{u,\tau_L} > P_{v,\tau_L}$$

Let b be the output of CA with a as input, with $b_u$ and $b_v$ the compressed counterpart of u and v respectively:

$$b = b_u + b_v$$

Figure 9F:
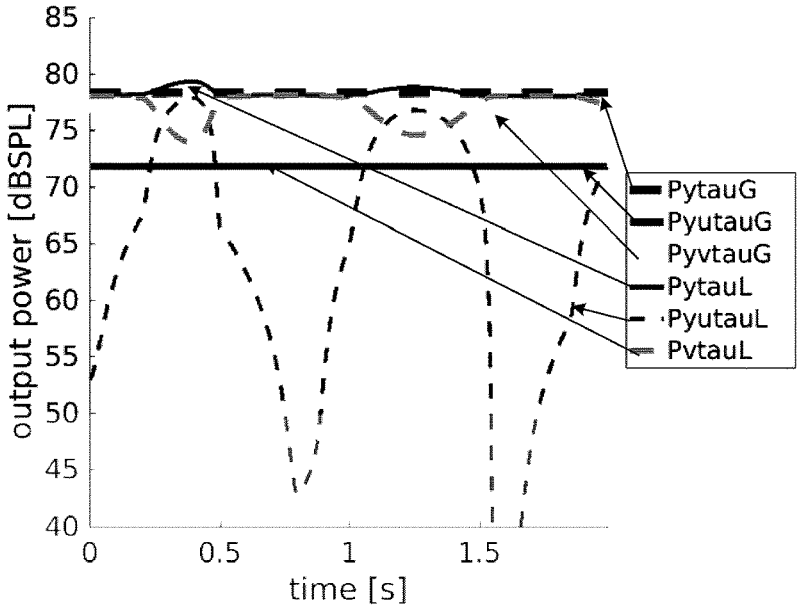
FIG. 9F shows the short and long term power of the temporal envelope of a strongly time domain modulated signal, a weakly time domain modulated signal and the sum of these two signals at the output of a CA system.

$P_{b_u,\tau_L}$, $P_{b_v,\tau_L}$, $P_{b_u,\tau_L}$, $P_{b_v,\tau_G}$ and $P_{b,\tau_G}$ (respectively labelled PbutauL, PbvtauL, PbtauL, PbutauG, PbvtauG and PvtauG on FIG. 9F) are their short and long term power respectively.

FIG. 9E and FIG. 9F show that the strongly modulated signal u tends to receive less gain on average than the weakly modulated signal v. Because of this, the long term output SNR $SNR_{O,\tau_G}$ might differ from the long term input SNR $SNR_{I,\tau_G}$.

If u represents the speech and v the noise (case 2a), $SNR_{I,\tau_G} \leq 0$ (negative long term input SNR): The long term power relationship between u and v is defined above with $P_{u,\tau_G} \leq P_{v,\tau_G}$. Noise is louder than speech.

$$\sigma^2_{P_{u,\tau_L}} \geq \sigma^2_{P_{v,\tau_L}}:$$

Speech is more modulated than noise.

Figure 9G:
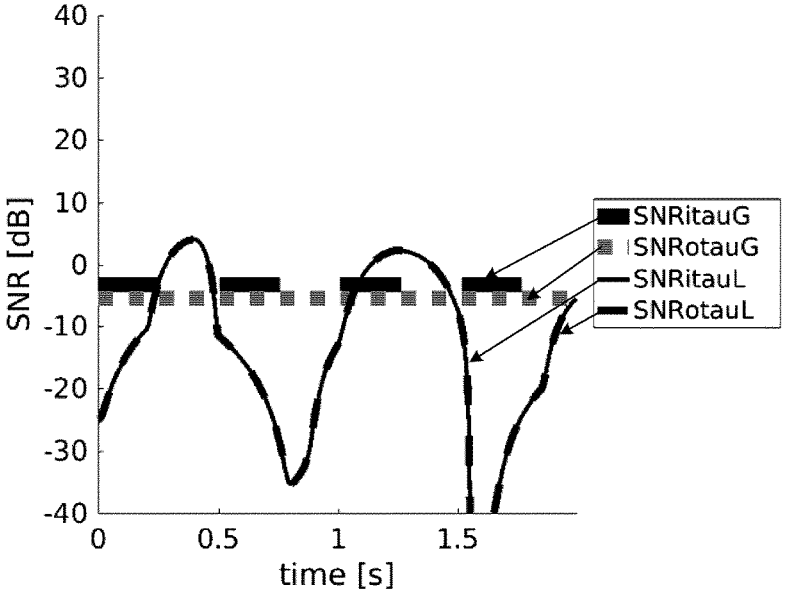
FIG. 9G shows the CA system input and output SNR if the weakly modulated time domain signal of FIG. 9E is the noise.

CA introduces an SNR degradation ($SNR_{I,\tau_G} \geq SNR_{O,\tau_G}$), as shown by FIG. 9G ($SNR_{I,\tau_L}$, $SNR_{I,\tau_G}$, $SNR_{O,\tau_L}$ and $SNR_{O,\tau_G}$ being labelled SNRitauL, SNRitauG, SNRotauL and SNRotauG respectively), because the short time segments that have the lowest SNR are the segments that have the lowest short time power $P_{a,\tau_L}$ and also receive the most gain.

Typical soundscape: soft speech in medium/loud noise.

Soundscape likelihood: Medium. a might typically be speech in relatively loud but unmodulated noise. Although this situation is theoretically very likely, the usage of a NR system in front of the CA (see section 2), decreases the likelihood of such a signal at the input of the CA. It tends to transform it into the soundscape speech in soft noise (case 1a).

Soundscape relevance: High. If such a signal is present at the CA input, even with a NR system placed in front of the CA (see section 2), it means that the NR system is not able to extract speech from noise, because the noise is much stronger than speech ($P_{v,\tau_G} >> P_{u,\tau_G}$). The resulting signal has a flat envelope. This soundscape has no relevance for linearized amplification: Indeed, although the envelope level might be located in a range were the amplification is not linear, a flat envelope produces a nearly constant gain, i.e. minimal SNR degradation. However, such a soundscape has a high relevance because it actually tends to the noise (only) soundscape ($SNR_{I,\tau_G} \rightarrow -\infty$). In this situation, the HI user might benefit from reduced amplification (see the description of Gain Relaxing in the SUMMARY section above) instead of linearized amplification.

Note: This situation might happen to be broadband, i.e. if u=s, v=d, a=x, $b_u=y_u$, $b_v=y_v$ and, b=y or in some sub-band m, i.e. $u=s_m$, $v=d_m$, $a=x_m$, $b_u=y_{s_m}$, $b_v=y_{d_m}$ and, $b=y_m$.

If v represents the speech and u the noise (case 2b), $SNR_{I,\tau_G}\geq 0$ (positive long term input SNR): The long term power relationship between u and v is defined above with $P_{u,\tau_G}\leq P_{v,\tau_G}$. Speech is louder than noise.

$$\sigma^2_{P_{u,\tau_L}} \geq \sigma^2_{P_{v,\tau_L}}:$$

Speech is less modulated than noise.

Figure 9H:
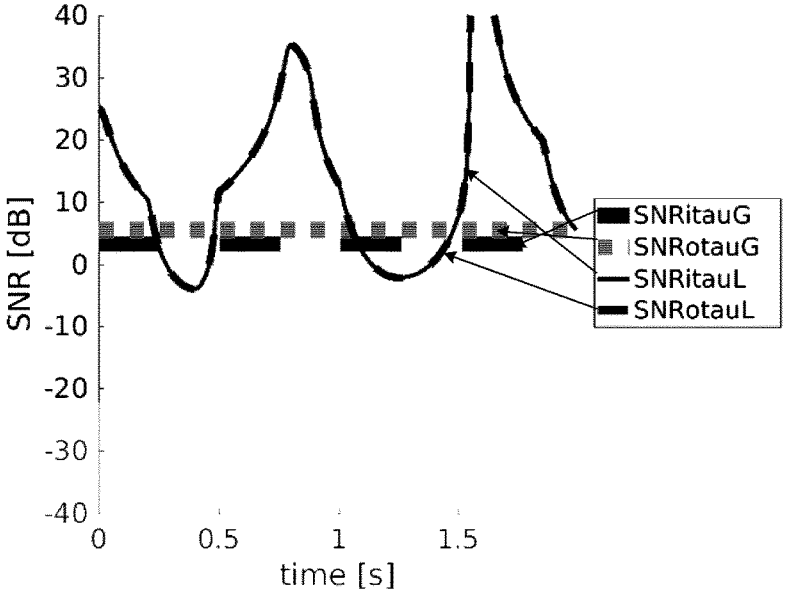
FIG. 9H shows the CA system input and output SNR if the strongly modulated time domain signal of FIG. 9E is the noise.

CA introduces an SNR improvement ($SNR_{I,\tau_G}\leq SNR_{O,\tau_G}$), as shown by FIG. 9H ($SNR_{I,\tau_L}$, $SNR_{I,\tau_G}$, $SNR_{O,\tau_L}$ and $SNR_{O,\tau_G}$ being labelled SNRitauL, SNRitauG, SNRotauL and SNRotauG respectively), because the short time segments that have the highest SNR are the segments that have the lowest short time power $P_{a,\tau_L}$ and also receive the most gain.

Typical soundscape: speech in soft noise

Soundscape likelihood: Medium. a might be speech corrupted by soft but strongly modulated noise. Some specific soft noise might be strongly modulated (e.g. computer keyboard). On the other hand, speech is generally much more modulated than v, probably not so much less modulated than the modulated noise. So the SNR improvement might be negligible.

Soundscape relevance: Low. Such low level and modulated noise might not require any linearization because they might contain relevant information for the HI user. Like for speech, classic compressive amplification behavior might even be expected. On the other hand, if the noise is really strongly modulated and annoying (soft impulsive noise), dedicated transient noise reduction algorithms should be used.

Note: This situation might happen to be broadband, i.e. if u=s, v=d, a=x, $b_u=y_u$, $b_v=y_v$ and, b=y or in some sub-band m, i.e. $u=s_m$, $v=d_m$, $a=x_m$, $b_u=y_{s_m}$, $b_v=y_{d_m}$ and, $b=y_m$.

Summary for compressive amplification of the modulated temporal envelope:

Only the cases where speech is more modulated than noise (1a and 2a) are most likely and indeed relevant: The discussion can be limited to the two cases: Positive versus negative input SNR.

In case of negative input SNR (case 2a), SNR improvement are unlikely. However, instead of using linearization techniques (e.g. Compression Relaxing), it is more helpful to decrease the amplification (e.g using Gain Relaxing).

CA tends to degrade the SNR when the input SNR is positive (case 1a). In that case, linearizing the CA locally in time (e.g. using Compression Relaxing) might limit the SNR degradation.

SNR and Modulated Spectral Envelope

Let be $a_m$ the sum of two orthogonal sub-bands signals $u_m$ and $v_m$, i.e $$a_m=u_m+v_m$$

and $$P_{a_m,\tau}=P_{u_m,\tau}+P_{v_m,\tau}$$

Let $u_m$ have a higher spectral contrast than $v_m$, i.e. $u_m$ has a spectral envelope that is more modulated than the spectral envelope of $v_m$. This means that the variance $$\sigma^2_{P_{u_m,\tau}}$$

of $P_{u_m,\tau}$ is larger than the variance $$\sigma^2_{P_{v_m,\tau}}$$

of $P_{v_m,\tau}$, i.e.

$$\sigma^2_{P_{u_m,\tau}} \geq \sigma^2_{P_{v_m,\tau}}$$

With $$\sigma^2_{P_{u_m,\tau}} = E[(P_{u_m,\tau} - E[P_{u_m,\tau}])^2] = E[P^2_{u_m,\tau}] - E[P_{u_m,\tau}]^2$$

And $$\sigma^2_{P_{u_m,\tau}} = E[(P_{v_m,\tau} - E[P_{v_m,\tau}])^2] = E[P^2_{v_m,\tau}] - E[P_{v_m,\tau}]^2$$

The variances can be estimated as follows:

$$\hat{\sigma}^2_{P_{u_m,\tau}} = \frac{1}{M}\sum_{m=0}^{M-1} P^2_{u_m,\tau} - P^2_{u,\tau}$$

Respectively $$\hat{\sigma}^2_{P_{v_m,\tau}} = \frac{1}{K}\sum_{k=0}^{K-1} P^2_{v_m,\tau} - P^2_{v,\tau}$$

Let u have a broadband power larger than v, i.e.

$$P_{u,\tau}\geq P_{v,\tau}$$

Figure 9I:
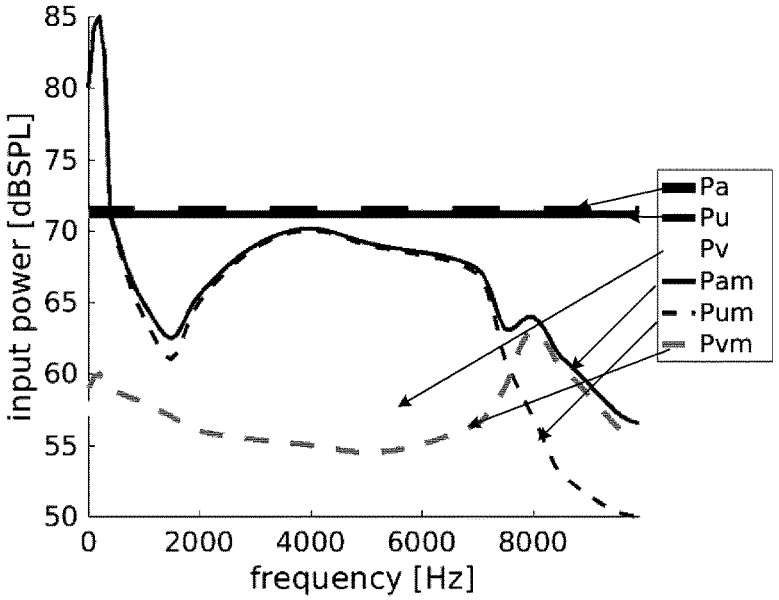
FIG. 9I shows the sub-band and broadband power of the spectral envelope of a strongly modulated frequency domain signal, a weakly modulated frequency domain signal and the sum of these two signals at the input of a CA system.

The situation is illustrated by an example on FIG. 9I, where signals $P_{u_m,\tau}$, $P_{v_m,\tau}$, $P_{a_m,\tau}$, $P_{u,\tau}$, $P_{v,\tau}$ and $P_{a,\tau}$ are labelled Pum, Pvm, Pam, Pu, Pv and Pa respectively. $P_{v_m,\tau}$ is relatively stable while $P_{u_m,\tau}$ is strongly modulated.

On the peak of the spectral envelope (e.g. approximately 200 Hz) the total power $P_{a_m,\tau}$ is dominated by $P_{u_m,\tau}$:

$$P_{a_m,\tau}\rightarrow P_{u_m,\tau}^{+}$$

Because $$P_{u_m,\tau}>>P_{v_m,\tau}$$

On the other hand, in the modulated envelope valleys (e.g. 8 kHz) the total power $P_{a_m,\tau}$ is essentially made of $P_{v_m,\tau}$ only:

$$P_{a_m,\tau}\rightarrow P_{v_m,\tau}^{+}$$

Because $$P_{u_m,\tau}\rightarrow 0^{+}$$

Let $b_m$ be the output of CA with a as input, with $b_{u_m}$ and $b_{v_m}$ the compressed counterpart of $u_m$ and $v_m$ respectively:

$$b_m = b_{u_m} + b_{v_m}$$

$$P_{b_{u_m},\tau},\ P_{b_{v_m},\tau},$$

$P_{b_m,\tau}$, $P_{b_u}$, $P_{b_v,\tau}$ and $P_{b,\tau}$ (respectively labelled Pbum, Pbvm, Pbm, Pbu, Pbv and Pb on FIG. 9J) are their sub-band and broadband power respectively.

Figure 9J:
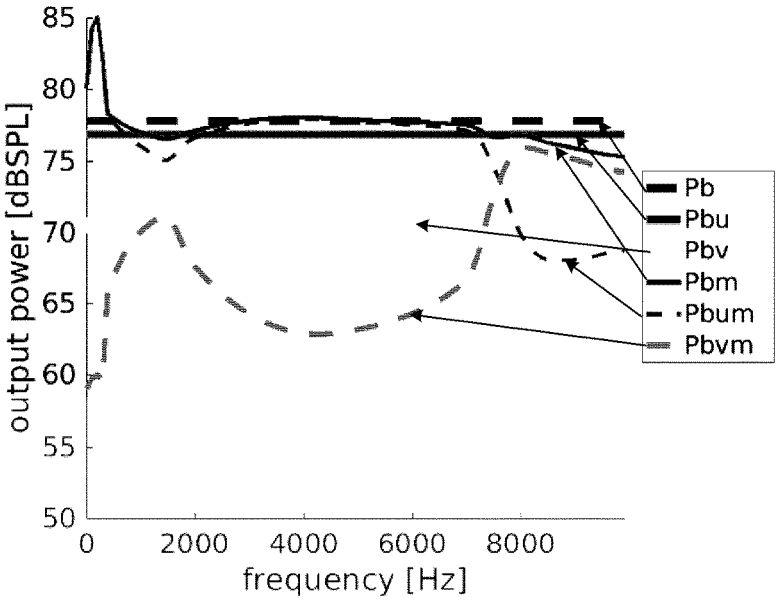
FIG. 9J shows the sub-band and broadband power of the spectral envelope of a strongly modulated frequency domain signal, a weakly modulated frequency domain signal and the sum of these two signals at the output of a CA system.

FIG. 9I and FIG. 9J show that the strongly modulated signal $u_m$ tends to get less gain in average than the weakly modulated signal $v_m$. Because of this, the broadband output SNR $SNR_{O,\tau}$ might differ from the broadband input SNR $SNR_{I,\tau}$.

If $u_m$ represents the speech and $v_m$ the noise (case 1a), the soundscape can be describe as follows:

$SNR_{I,\tau} \geq 0$ (positive broadband input SNR): The broadband power relationship between u and v is defined above with $P_{u,\tau} \geq P_{v,\tau}$. Speech is louder than noise.

$$\sigma^2_{P_{u_m},\tau} \geq \sigma^2_{P_{v_m},\tau}:$$

Speech has more spectral contrast than noise.

Figure 9K:
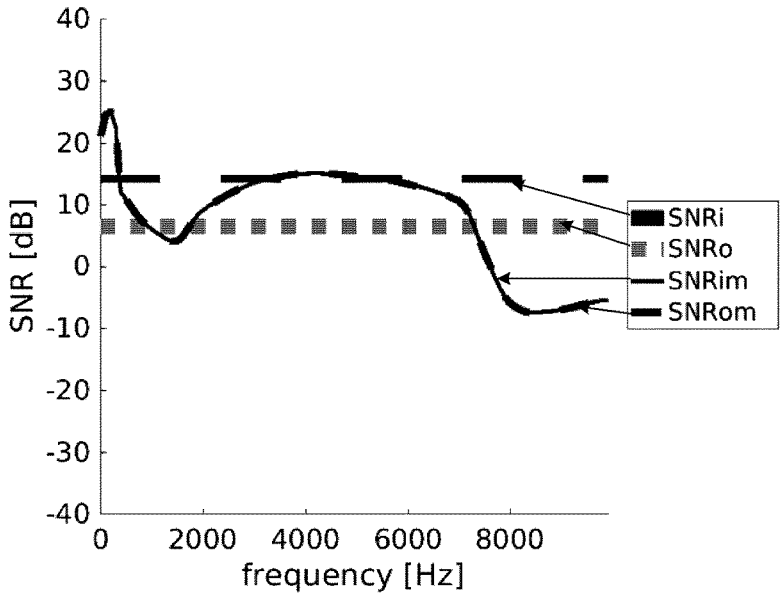
FIG. 9K shows the CA system input and output SNR if the weakly modulated signal of FIG. 9I is the noise.

CA introduces an SNR degradation ($SNR_{I,\tau} \geq SNR_{O,\tau}$), as shown by FIG. 9K ($SNR_{I,m,\tau}$, $SNR_{I,\tau}$, $SNR_{O,m,\tau}$ and $SNR_{O,\tau}$ being labelled SNRim, SNRi, SNRom and SNRo respectively), because the sub-bands that have the lowest SNR tends[1] to be the sub-bands that have the lowest sub-band power $P_{a,m,\tau}$ and by the way receive the most gain.

Typical soundscape: speech in soft noise

Soundscape likelihood: High. a might typically be speech in relatively soft noise with flat power spectral density. E.g. offices, home, etc.

Soundscape relevance: High. At this kind of level, compressive amplification is applied, so the SNR might be degraded. Note that if the input SNR is extremely large (soundscape clean speech), i.e. $SNR_{I,\tau} \to +\infty$, then the output SNR cannot be degraded, i.e. $SNR_{O,\tau} \to \infty$.

[1] Contrary to the time domain where level changes produce gain variation according to a compressive mapping curve, in the frequency domain, the gain changes produced by level changes as a function of the frequency might not follow a compressive mapping curve. Level changes as a function of the frequency might even produce gain changes using an expansive mapping curve. However, the average gain changes as a function of the level changes along the frequency axis, where the averaging is done over a sufficiently large sample of HA user fitted gain, produce a compressive mapping curve. In other words, the average fitted gain shows a compressive level to gain mapping curve along the frequency axis.

Note: This situation might happen over a long term ($\tau = \tau_G$) or a short term ($\tau = \tau_L$).

If $v_m$ represents the speech and $u_m$ the noise (case 1b), the soundscape can be describe as follows:

$SNR_{I,\tau} \leq 0$ (negative broadband input SNR): The broadband power relationship between u and v is defined above with $P_{u,\tau} \geq P_{v,\tau}$. Noise is louder than speech.

$$\sigma^2_{P_{u_m},\tau} \geq \sigma^2_{P_{v_m},\tau}:$$

Noise has more spectral contrast than speech.

Figure 9L:
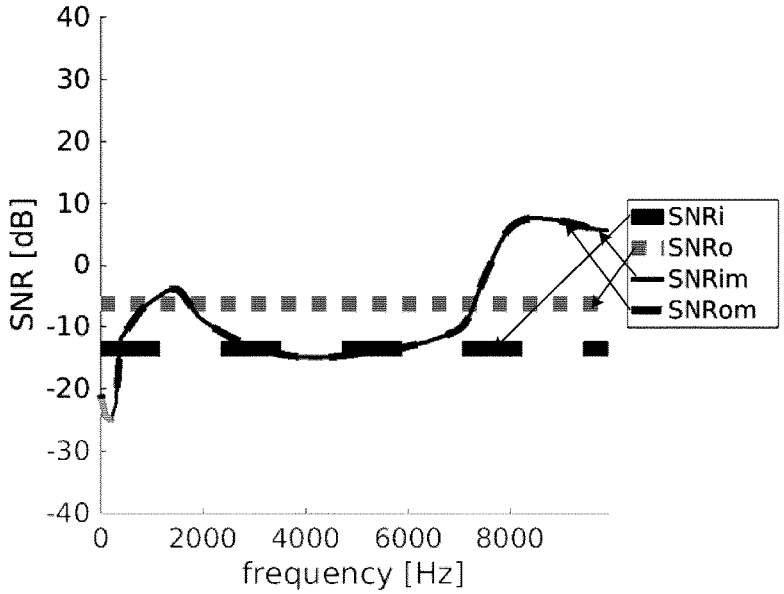
FIG. 9L shows the CA system input and output SNR if the strongly modulated signal of FIG. 9I is the noise.

CA introduces an SNR improvement ($SNR_{I,\tau} \leq SNR_{O,\tau}$), as shown by FIG. 9L ($SNR_{I,m,\tau}$, $SNR_{I,\tau}$, $SNR_{O,m,\tau}$ and $SNR_{O,\tau}$ being labelled SNRim, SNRi, SNRom and SNRo respectively), because the sub-bands that have the highest SNR tends to be the sub-bands that have the lowest sub-band power $P_{a,m,\tau}$ and by the way receive the most gain (see note 1 above).

Typical soundscape: speech in loud noise

Soundscape likelihood: Low. a might be a relative soft speech corrupted by loud and strongly colored noise. In general, speech has much more spectral contrast than $v_m$. In fact noisy signal with much more spectral contrast than speech are relatively unlikely. For most of the noisy signals, the spectral contrast is similar to speech in the worst case. This is even more unlikely if a NR system is placed in front of the CA (see section 2): The NR will apply a strong attenuation in the sub-bands where noise is louder than speech, actually flattening the noise power spectral density at the input of the CA. So in general, the SNR improvement are expected to be negligible.

Soundscape relevance: Medium. The loudness of this kind of noisy signals might be in a range where the amplification is not linear. On the other hand, it might also be loud enough to reach level ranges where the amplification is linear Note: This situation might happen over the long term ($\tau = \tau_G$) or the short term ($\tau = \tau_L$).

Let v have a broadband power larger than u, i.e.

$$P_{v,\tau} \geq P_{u,\tau}$$

Figure 9M:
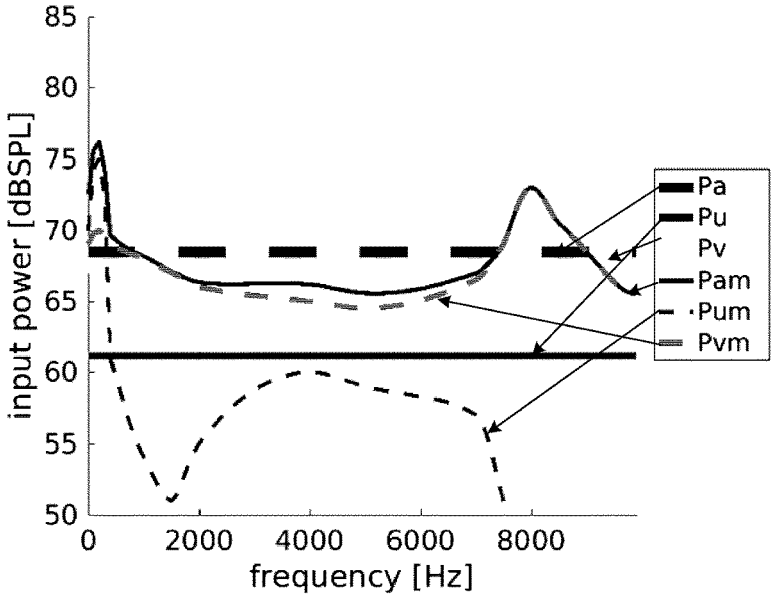
FIG. 9M shows the sub-band and broadband power of the spectral envelope of a strongly modulated frequency domain signal, a weakly modulated frequency domain signal and the sum of these two signals at the input of a CA system.

The situation is illustrated by an example on FIG. 9M, where signals $P_{u_m,\tau}$, $P_{v_m,\tau}$, $P_{a_m,\tau}$, $P_{u,\tau}$, $P_{v,\tau}$, and $P_{a,\tau}$ are labelled Pum, Pvm, Pam, Pu, Pv and Pa respectively. $P_{v_m,\tau}$ is relatively stable while $P_{u_m,\tau}$ is strongly modulated.

Because $v_m$ has more power than $u_m$, $a_m$ has a relative weak spectral contrast, similar to $v_m$. In general, the total power $P_{a_m,\tau}$ is dominated by $P_{v_m,\tau}$, i.e.

$$P_{a_m,\tau} \to P_{v_m,\tau}^{+}$$

except on the peaks of the spectral envelope (e.g at approximately 200 Hz) where $P_{u_m,\tau}$ is not negligible, i.e.:

$$P_{u_m,\tau} \approx P_{v_m,\tau}$$

Or even $$P_{u_m,\tau} > P_{v_m,\tau}$$

Let $b_m$ be the output of CA with a as input, with $b_{u_m}$ and $b_{v_m}$ the compressed counterpart of $u_m$ and $v_m$ respectively:

$$P_{b_{u_m},\tau},\ P_{b_{v_m},\tau},$$

$P_{b_m,\tau}$, $P_{b_u}$, $P_{b_v,\tau}$ and $P_{b,\tau}$ (respectively labelled Pbum, Pbvm, Pbm, Pbu, Pbv and Pb on FIG. 9N) are their sub-band and broadband power respectively.

Figure 9N:
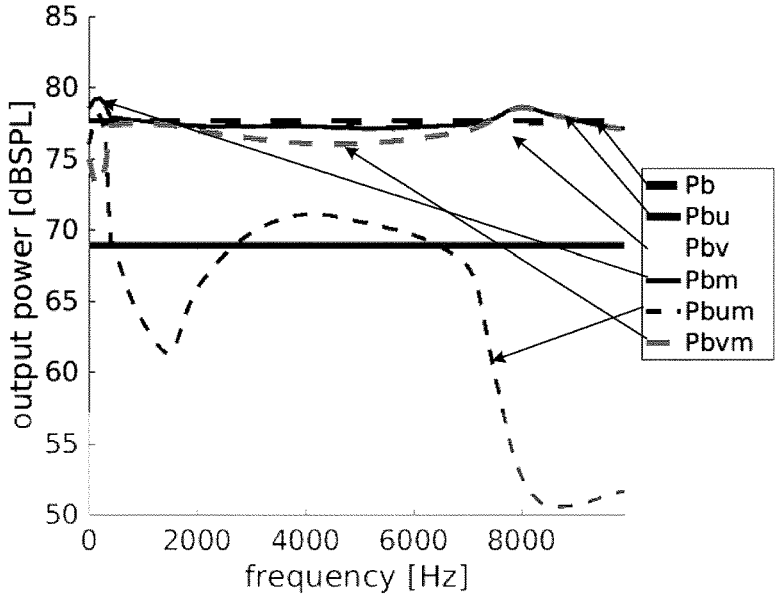
FIG. 9N shows the sub-band and broadband power of the spectral envelope of a strongly modulated frequency domain signal, a weakly modulated frequency domain signal and the sum of these two signals at the output of a CA system.

FIG. 9M and FIG. 9N show that the strongly modulated signal $u_m$ tends to get less gain in average than the weakly modulated signal $v_m$. Because of this, the broadband output SNR $SNR_{O,\tau}$ might differ from the broadband input SNR $SNR_{I,\tau}$.

If $u_m$ represents the speech and $v_m$ the noise (case 2a), the soundscape can be describe as follows:

$SNR_{I,\tau} \leq 0$ (negative broadband input SNR): The broadband power relationship between u and v is defined above with $P_{v,\tau} \geq P_{u,\tau}$. Noise is louder than speech.

$$\sigma^2_{P_{u_m,\tau}} \geq \sigma^2_{P_{v_m,\tau}}:$$

Speech has more spectral contrast than noise.

Figure 9O:
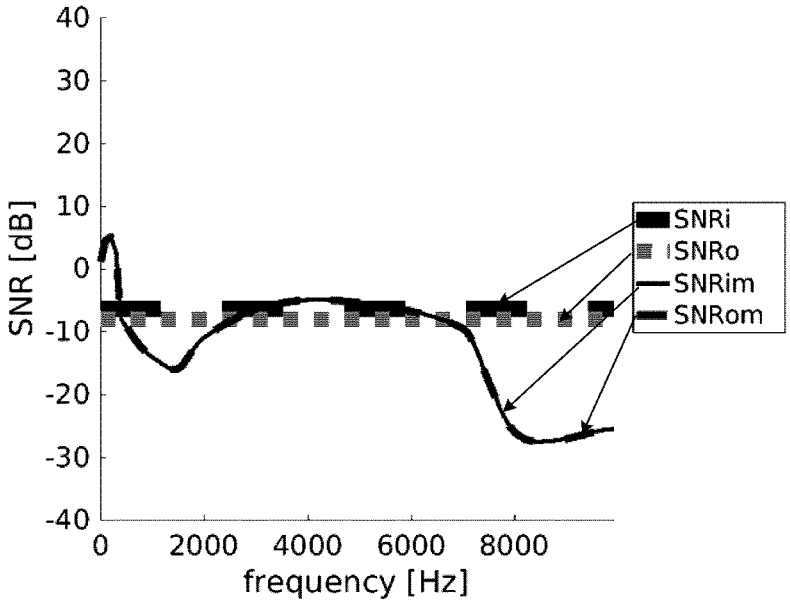
FIG. 9O shows the CA system input and output SNR if the weakly modulated signal of FIG. 9M is the noise.

CA introduces an SNR degradation ($SNR_{I,\tau} \geq SNR_{O,\tau}$), as shown by FIG. 9O ($SNR_{I,m,\tau}$, $SNR_{I,\tau}$, $SNR_{O,m,\tau}$ and $SNR_{O,\tau}$ being labelled SNRim, SNRi, SNRom and SNRo respectively), because the sub-bands that have the lowest SNR tends to be the sub-bands that have the lowest sub-band power $P_{a,m,\tau}$ and by the way get the highest gain (see note 1 above).

Typical soundscape: soft speech in medium/loud noise

Soundscape likelihood: Medium. a might typically be speech in relatively loud noise with flat power spectral density. Although this situation is theoretically very likely, the usage of a NR system in front of the CA (see section 2), decrease the likelihood of such a signal at the input of the CA.

Soundscape relevance: High. If such a signal is present at the CA input, even with a NR system placed in front of the CA (see section 2), it means that the NR system is not able to extract speech from noise, because the noise is much stronger than speech ($P_{v,\tau} >> P_{u,\tau}$). In such situation the potential SNR degradation are relatively negligible compared to the fact the compressor is actually amplifying a signal that either is strongly dominated by noise or even is pure noise. So, this soundscape has no relevance for linearized amplification. However, it has a high relevance because it actually tends to the noise (only) soundscape ($SNR_{I,\tau_G} \rightarrow -\infty$). If such a soundscape tends to last, the HI user might benefit from reduced amplification (see the description of Gain Relaxing in the SUMMARY) instead of a linearized amplification.

Note: This situation might happen over the long term ($\tau=\tau_G$) or the short term ($\tau=\tau_L$).

If $v_m$ represents the speech and $u_m$ the noise (case 2b), the soundscape can be describe as follows:

$SNR_{I,\tau} \geq 0$ (positive broadband input SNR): The broadband power relationship between u and v is defined above with $P_{v,\tau} \geq P_{u,\tau}$. Speech is louder than noise.

$$\sigma^2_{P_{u_m,\tau}} \geq \sigma^2_{P_{v_m,\tau}}:$$

Noise has more spectral contrast than speech.

Figure 9P:
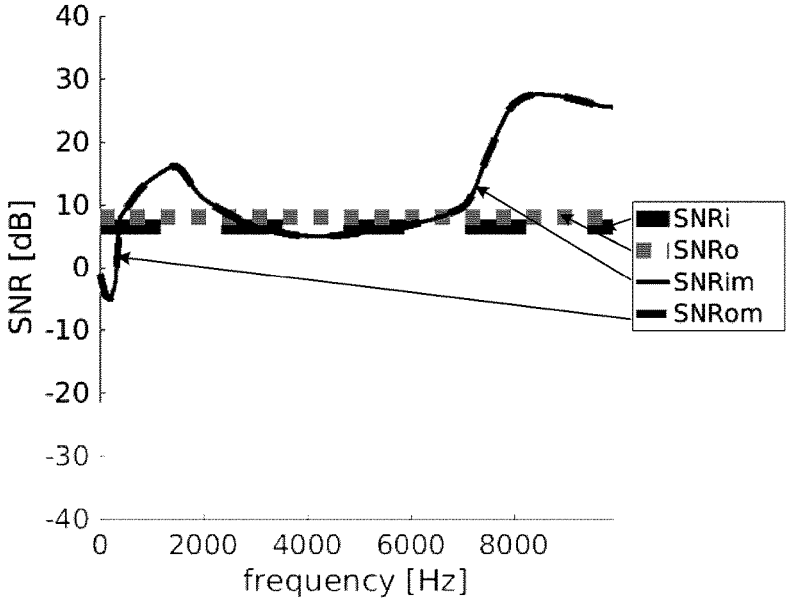
FIG. 9P shows the CA system input and output SNR if the strongly modulated signal of FIG. 9M is the noise.

CA introduces an SNR improvement ($SNR_{I,\tau} \leq SNR_{O,\tau}$), as shown by FIG. 9P ($SNR_{I,m,\tau}$, $SNR_{I,\tau}$, $SNR_{O,m,\tau}$ and $SNR_{O,\tau}$ being labelled SNRim, SNRi, SNRom and SNRo respectively), because the sub-bands that have the highest SNR tends to be the sub-bands that have the lowest sub-band power $P_{a,m,\tau}$ and also receive the most gain (see note 1 above).

Typical soundscape: speech in soft noise

Soundscape likelihood: Low: a might be speech corrupted by soft but strongly colored noise. In general, speech has much more spectral contrast than $v_m$. In fact noisy signals with much more spectral contrast than speech are relatively unlikely. For most of the noisy signals, the spectral contrast is similar to speech in the worst case. This is even more unlikely if a NR system is placed in front of the CA (see section 2): The NR will apply a strong attenuation in the sub-bands where noise is louder than speech, actually flattening the noise power spectral density at the input of the CA. So in general, the SNR improvement are expected to be negligible.

Soundscape relevance: High. At this kind of level, compressive amplification is applied, so the SNR might be improved.

Note: This situation might happen over the long term ($\tau=\tau_G$) or the short term ($\tau=\tau_L$).

Summary for compressive amplification of the modulated spectral envelope:

Only the cases where speech has more spectral contrast than noise (1a and 2a) are sufficiently likely and relevant: The discussion can be limited to the two cases: Positive versus negative input SNR.

In case of negative input SNR (case 2a), SNR improvement are unlikely. However, instead of using linearization techniques (e.g. Compression Relaxing), it is more helpful to decrease the amplification (e.g using Gain Relaxing).

CA tends to degrade the SNR when the input SNR is positive (case 1a). In that case, linearizing the CA locally in frequency (e.g. using Compression Relaxing) might limit the SNR degradation.

Conclusion (CA and SNR Degradation)

In theory, CA is not systematically a bad things in terms of SNR. However, the cases where one can expect CA to cause SNR improvements are almost unlikely and irrelevant, in particular if, as it is the case in modern hearing instruments (see next section), CA is placed behind a noise reduction (NR) system. In conclusion, CA should be considered as globally counter-productive in terms of SNR.

2. Noise Reduction and Compressive Amplification:

Because a noise reduction (NR) systematically improves the SNR ($SNR_O \geq SNR_I$), while CA improves the SNR if it is negative at its input, i.e. $SNR_O \geq SNR_I$ if $SNR_I < 0$, but degrades it if it is positive at its input, i.e $SNR_O \leq SNR_I$ if $SNR_I > 0$, (see section 1, SNR and Modulated Temporal Envelope as well as SNR and Modulated Spectral Envelope), one might be tempted to conclude that the optimal setup places the CA before the NR, maximizing the chances of SNR improvement.

However, such a design ignores that:

NR placed at the output of the compressor is limited to single signal NR techniques like spectral subtraction/wiener filtering. Indeed, noise cancellation and beamforming, because they require the use of signals from multiple microphones, can only be placed in front of the compressor. Consequently, placing the NR behind CA forces technical limitations on the used NR algorithm, bounding artificially the NR performance.

The environments with positive and negative $SNR_I$ are not equally probable: Indeed, it may be reasonable to assume that impaired people wearing hearing aids won't spend much time in very noisy environments, where theoretically CA might improve the SNR. They will naturally prefer to spend more time in environments where:

The level is low to medium and $SNR_I$ is positive (speech in relative quiet or soft noise).

The level is low and the $SNR_I$ is very negative (quiet environment with no speech nor loud noise source). Because the noise level tends to be, by definition, very low, it is very likely to be below the first compression knee point, i.e. in an input level region where the amplification is linear, making the compressor potentially useless for SNR improvement. Even if the noise level is not below the first compression knee point, such kind of noise cannot be strongly modulated, strongly limiting the benefits of CA in terms of SNR improvements.

On one hand, let assume that one can design an arbitrarily good NR scheme that is able to remove 100% of the noise, i.e. systematically producing an infinite output SNR, independently of whether it is placed before or after the CA. On the other hand, it is well known that an NR scheme can, by definition, only attenuate the signal. So, at the input of the CA, the noisy input signal can only be softer if the NR is placed before the CA than if there is no NR or if the NR is placed after the CA. If one use the arbitrarily good NR scheme described above, the output signal of the whole system, NR and CA, has an infinite SNR (independently of where one would place the NR) but it is under-amplified if the NR is placed after the CA compared to a placement before the CA. Indeed if the NR is placed after the CA, the CA is analyzing a noise corrupted signal that can only be louder that its noise free counterpart, and by the way get less gain, which would result in a poorer HLC performance. Consequently, the better the NR scheme, the more sense it makes to place the NR before the CA.

It is better to place the NR in front of the CA. For SNR based CA according to the present disclosure, there is virtually no reason to not place the NR at the output of the compressor.

For completeness purpose, let's discuss both NR placed at the input as well as at the output of the compressor.

NR Placement Relative to CA:

Using a noise reduction (NR) system (e.g. comprising directionality (spatial filtering/beamforming) and noise suppression) potentially provides global SNR improvements but does not prevent the SNR degradation caused by classic CA. This is independent of the NR location (i.e. at the input or the output of the CA).

NR at the CA Output:

The SNR of the source signal can be:

Negative: The CA may provide some SNR improvements. However, the SNR will remain negative. Such a signal is still extremely challenging for any NR scheme, in particular if it is limited to spectral subtraction/wiener filtering techniques (see discussion above). From a hearing loss compensation point of view, such a signal should be considered as a pure noise and it would be probably even better to limit the amplification or even switch if off completely.

Positive: The CA will degrade the SNR, increasing the need for more NR. This behavior is obviously counter-productive from a NR point of view.

NR at the CA Input:

As long as the NR is not able to increase the SNR to infinity (which is of course not realistic), there is still residual noise at the NR output. The SNR of the NR output signal can be:

Negative: If the residual noise is still very strong, the SNR might be negative. In this case, the CA may help to further increase the SNR. However, from a hearing loss compensation point of view, such a signal should be considered as a pure noise and it would be probably even better to limit the amplification or even switch it off completely.

Positive: If the residual noise is weak enough, the SNR might be positive. In this case, the CA tends to decrease the SNR, which is counter-productive from a NR point of view.

In fact, the better the NR scheme, the higher the likelihood of a positive SNR at the output of the NR. In other words, the better the NR scheme, the more important is the design of the enhanced CA, capable of minimizing the SNR degradation. This can be accomplished with a system like SNRCA according to the present disclosure that limits the amount of SNR degradation.

3. The SNR Driven Compressive Amplification System (SNRCA):

The SNRCA is a concept designed to alleviate the undesired noise amplification caused by applying CA on noisy signals. On the other hand, it provides classic CA like amplification for noise-free signals.

Among the 4 cases (1a, 1b, 2a, and 2b for time domain as well as for frequency domain) described in an above section 1, only cases 1a and 2a are relevant use cases for modern HA (i.e. HA using NR placed before the compressor) that describe how the SNRCA must behave and what it must achieve:

1. Case 1a: With noisy speech signals (global input SNR: low to high) i.e. speech in noise, SNRCA must noticeably reduce the undesired noise amplification that could potentially occur on low local (sub-bands and/or short signal segments) input SNR signal parts, while maintaining classic CA like amplification (i.e. shall not noticeably deviate from classic CA amplification) on high local (sub-bands and/or short signal segments) input SNR signal parts.
2. Case 1a: With clean speech signals (global input SNR: infinite or very high), SNRCA must provide classic CA like amplification, i.e. shall not noticeably deviate from classic CA amplification: No noticeable distortions nor over- or under-amplification.
3. Case 2a: With pure (weakly modulated) noise signals (global input SNR: minus infinity or very low), SNRCA must relax the amplification (decrease the overall gain) allocated by CA (classic CA allocates the gain as if the signal is speech, i.e. ignoring the global SNR).

The above 3 use cases can be interpreted as follows:

1. SNRCA must reduce the compression for local signal parts where the (local) SNR is below the global SNR, to avoid undesired noise amplification, while maintaining compression for local parts of the signal where the (local) SNR is above the global SNR, to avoid both under-amplification and over-amplification. This is a requirement about linearization, i.e. compression relaxing
2. SNRCA must ensure that pure/clean speech receives the prescribed amplification. This is a requirement about speech distortion minimization.
3. SNRCA must avoid amplifying pure noise signals as if they are speech signals. This is a requirement about gain relaxing.

Requirement: Speech Distortion Minimization:

The minimal distortion requirement will only be guaranteed by proper design and configuration of the linearization and gain relaxing mechanisms, such that, in very high SNR conditions, they will not modify the expected gain in a direction that is away from the prescribed gain and compression that is achieved by classic CA.

Requirement: Linearization/Compression Relaxing:

It is possible to imagine achieving SNR dependent linearization by increasing the time constants used by the level estimation based on the SNR estimate.

However, this solution has a severe limitation: Slowed down CA minimizes undesired noise amplification at the risk of over-amplification at speech onset or transients.

Instead, it is proposed to provide an SNR based post-processing of the level estimate. In an embodiment, an SNR controlled level offset is provided, whereby SNRCA linearizes the level estimate for a decreasing SNR.

Requirement: Gain Relaxing:

Gain relaxing is provided, when the signal contains no speech but only weakly modulated noise, i.e. when the global (long-term and across sub-bands) SNR becomes very low.

The CA logically amplifies such a noise signal by a gain corresponding to its level. It is however questionable if such amplification of a noise is really useful? Indeed:

- the gain delivered is intended to be allocated for speech audibility restoration purpose. A pure noise signal does not match this use case.
- in addition to CA, a hearing aid will usually apply a noise reduction (NR) scheme. As stated above, it is obviously counter-productive that the CA amplifies a noise signal which is simultaneously attenuated by the noise reduction.

In other words, the CA delivered gain must be (at least partially) relaxed in such situations. Because such signals are weakly modulated, the role played by the time domain resolution (TDR, i.e. the used level estimation time constants) of the level estimation tends to be zero. Consequently, such a gain relaxing cannot be achieved by linearization (increasing the time constant, estimated level post correction, etc.)

Figure 3:
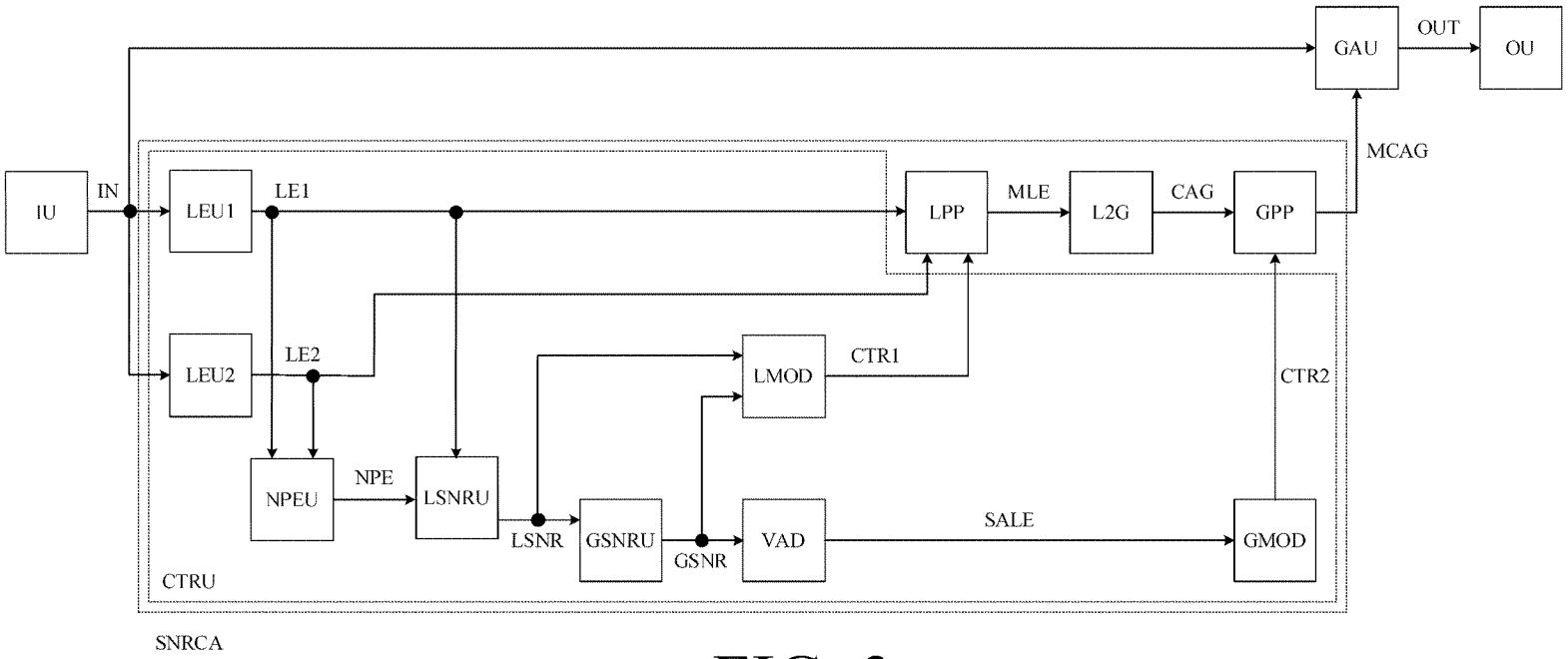
FIG. 3 shows a simplified block diagram for an embodiment of a hearing device comprising an SNR driven compressive amplification system according to the present disclosure.

However, SNRCA achieves gain relaxing by decreasing the gain at the output of the "Level to Gain Curve" unit as seen in FIG. 3.

SNRCA Processing and Processing Elements: Short Description

Using continuous local (short-term and sub-band) as well as global (long-term and broadband) SNR estimations, the proposed SNR driven compressive amplification system (SNRCA) is able to:

- Provide linearized compression to prevent SNR degradation while limiting under-amplification and completely avoid the over-amplification
- Provide reduced gain to prevent undesired noise amplification in speech absent situation.

Compared to classic CA, SNRCA based CA is made of 3 new components:

- Local and global SNR estimation stage
- Linearization (compression relaxing) by estimated level post-processing
- Gain reduction (gain relaxing) by post-processing the gain delivered by the application of compression characteristics SNRCA Processing and Processing Elements: Full Description.

FIG. 1 shows a first embodiment of a hearing device (HD) comprising a SNR driven dynamic compressive amplification system (SNRCA) according to the present disclosure. The hearing device (HD) comprises an input unit (IU) for receiving or providing an electrical input signal IN with a first dynamic range of levels representative of a time variant sound signal, the electric input signal comprising a target signal and/or a noise signal, and an output unit (OU) for providing output stimuli (e.g. sound waves in air, vibrations in the body, or electric stimuli) perceivable by a user as sound representative of the electric input signal (IN) or a processed version thereof. The hearing device (HD) further comprises a dynamic (SNR driven) compressive amplification system (SNRCA) for providing a frequency and level dependent gain (amplification or attenuation) MCAG, in the present disclosure termed the modified compressive amplification gain, according to a user's hearing ability. The hearing device (HD) further comprises a forward gain unit (GAU) for applying the modified compressive amplification gain MCAG to the electric input signal IN or a processed version thereof. A forward path of the hearing device (HD) is defined comprising the electric signal path from the input unit (IU) to the output unit (OU). The forward path includes the gain application unit (GAU) and possible further signal processing units.

The dynamic (SNR driven) compressive amplification system (SNRCA) (in the following termed 'the SNRCA unit', and indicated by the dotted rectangular enclosure in FIG. 1) comprises a level estimate unit (LEU) for providing a level estimate LE of the electrical input signal, IN. CA applies gain as a function of the (possibly in sub-bands) estimated signal envelope level LE. The signal IN can be modelled as an envelope modulated carrier signal (more about this model for speech signals below). The aim of CA consists of sufficient gain allocation depending of the temporal envelope level to compensate for the recruitment effect, guaranteeing audibility. For this purpose, only the modulated envelope contains relevant information, i.e. level information. The carrier signal, per definition, does not contains any level information. So, the analysis part of CA aims to achieve a precise and accurate envelope modulation tracking while removing the carrier signal. The envelope modulation is information encoded in relatively slow power level variation (time domain information). This modulation produces power variations that do not occur uniformly over the frequency range: The spectral envelope (frequency domain information) will (relatively slowly) change over time (sub-band temporal envelope modulation aka time domain modulated spectral envelope). As a consequence, CA must use a time domain resolution (TDR) high enough to guarantee good tracking of envelope variations. At such an optimal TDR, the carrier signal envelope is flat, i.e. not modulated. It only contains phase information, while the envelope contains the (squared) magnitude information, which is the information relevant for CA. However, observed at a higher TDR, the more or less harmonic and noisy nature of the carrier signal becomes measurable, corrupting the estimated envelope. The used TDR must be high enough to guarantee a good tracking of the temporal envelope modulation (it can explicitly be lower if a more linear behavior is desired) but not higher, otherwise the envelope level estimate tends to be corrupted by the residual carrier signal. In the case of speech, the signal is defined by the anatomy of the human vocal tract which by its nature is heavily damped [Ladefoged, 1996]. The human anatomy, despite sex, age, and individual differences creates signals that are similar and are quite well defined, such as vowels, for example [Peterson and Barney, 1952]. The speech basically originates with air pulsed out of the lungs optionally triggering the periodic vibrations of the vocal cords (more or less harmonic and noisy carrier signal) within the larynx that are then subjected to the resonances (spectral envelope) of the vocal tract that also include modifications by mouth and tongue movements (modulated temporal envelope). These modifications by the tongue and mouth create relatively slow changes in level and frequency in the temporal domain (time domain modulated spectral envelope). At a higher TDR, speech also consists of finer elements classified as temporal fine structure (TFS) that include finer harmonic and noisy characteristics caused by the constriction and subsequent release of air to form the fricative consonants for example. The carrier signal is actually the model of the TFS while the envelope modulation is the model for the effects caused by the vocal tract moves. More and more research shows that with sensorineural hearing loss individuals lose their ability to extract information from the TFS e.g. [Moore, 2008; Moore, 2014]. This is also apparent with age, as clients get older they have an increasingly difficult time accessing TFS cues in speech [Souza & Kitch, 2001]. In turn, this means that they rely heavily on the speech envelope for intelligibility. To the estimate the level, a CA scheme must select the envelope and remove the carrier signal. To realize this process, the LEU consists of a signal rectification (usually square rectification) followed by a (possibly non-linear and time-variant) low-pass filter. The rectification step removes the phase information but keeps the magnitude information. The low-pass filtering step smooth the residual high frequency magnitude variations that are not part of the envelope modulation but caused by high frequency component generated during the carrier signal rectification. To improve this process, one can typically pre-process IN to make it analytic, e.g. using Hilbert Transform. The SNRCA unit further comprises a level post processing unit (LPP) for providing a modified level estimate MLE (based on the level estimate LE) of the input signal IN in dependence of a first control signal CTR1. The SNRCA unit further comprises a level compression unit (L2G, also termed level to gain unit) for providing a compressive amplification gain CAG in dependence of the modified level estimate MLE and hearing data representative of a user's hearing ability (HLD, e.g. provided in a memory of the hearing device, and accessible to (e.g. forming part of) the level compression unit (L2G) via a user specific data signal USD). The user's hearing data comprises data characterizing the user's hearing impairment (e.g. a deviation from a normal hearing ability), typically including the user's frequency dependent hearing threshold levels. The level compression unit is configured to determine the compressive amplification gain CAG according to a fitting algorithm providing user specific level and frequency dependent gains. Based thereon, the level compression unit is configured to provide an appropriate (frequency and level dependent) gain for a given (modified) level MLE of the electric input signal (at a given time). The SNRCA unit further comprises a gain post processing unit (GPP) for providing a modified compressive amplification gain MCAG in dependence of a second control signal CTR2.

The SNRCA unit further comprises a control unit (CTRU) configured to analyse the electric input signal IN (or a signal derived therefrom) and to provide a classification of the electric input signal IN and providing the first and second control signals CTR1, CTR2 based on the classification.

Figure 2A:
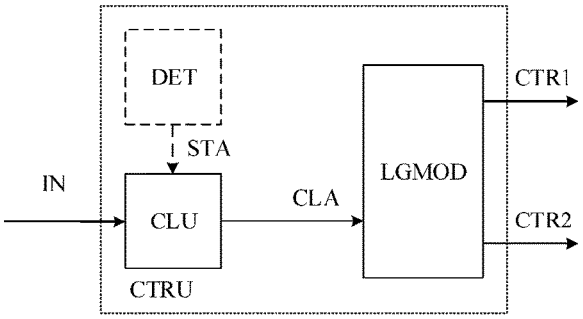
FIG. 2A shows a first embodiment of a control unit for a dynamic compressive amplification system for a hearing device according to the present disclosure.

FIG. 2A shows a first embodiment of a control unit (CTRU, indicated by the dotted rectangular enclosure in FIG. 2A) for a dynamic compressive amplification system (SNRCA) for a hearing device (HD) according to the present disclosure, e.g. as illustrated in FIG. 1. The control unit (CTRU) is configured to classify the acoustic environment in a number of different classes. The number of different classes may e.g. comprise one or more of <speech in noise>, <speech in quiet>, <noise>, and <clean speech>. The control unit (CTRU) comprises a classification unit (CLU) configured to classify the current acoustic situation (e.g. around a user wearing the hearing device) based on the electric input signal IN (or alternatively or additionally, based on or influenced by status signals STA from one or more detectors (DET), indicated in dashed outline/line in FIG. 2A) and to provide an output CLA indicative of or characterizing the acoustic environment (and/or the current electric input signal). The control unit (CTRU) comprises a level and gain modification unit (LGMOD) for providing first and second control signals CTR1 and CTR2 for modifying a level and gain, respectively, in level post processing and gain post processing units, LPP and GPP, respectively, of the SNRCA unit (cf. e.g. FIG. 1).

Figure 2B:
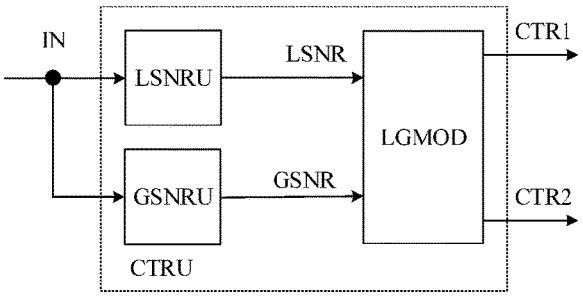
FIG. 2B shows a second embodiment of a control unit for a dynamic compressive amplification system for a hearing device according to the present disclosure.

FIG. 2B shows a second embodiment of a control unit (CTRU) for a dynamic compressive amplification system (SNRCA) for a hearing device (HD) according to the present disclosure. The control unit of FIG. 2B is similar to the embodiment of FIG. 2A. A difference is that the classification unit CLU of FIG. 2A in FIG. 2B is shown to comprise local and global signal-to-noise ratio estimation units (LSNRU and GSNRU, respectively). The local signal-to-noise ratio estimation unit (LSNRU) provides a relatively short-time ($\tau_L$) and sub-band specific ($\Delta f_L$) signal-to-noise ratio (signal LSNR), termed 'local SNR'. The global signal-to-noise ratio estimation unit (GSNRU) provides a relatively long-time ($\tau_G$) and broad-band ($\Delta f_G$) signal to noise ratio (signal GSNR), termed 'global SNR'. The terms relatively long and relatively short are in the present context taken to indicate that the time constant $\tau_G$ and frequency range $\Delta f_G$ involved in determining the global SNR (GSNR) are larger than corresponding time constant $\tau_L$ and frequency range $\Delta f_L$ involved in determining the local SNR (LSNR). The local SNR and the global SNR (signals LSNR and GSNR, respectively) are fed to the level and gain modification unit (LGMOD) and used in the determination of control signals CTR1 and CTR2.

Figure 2C:
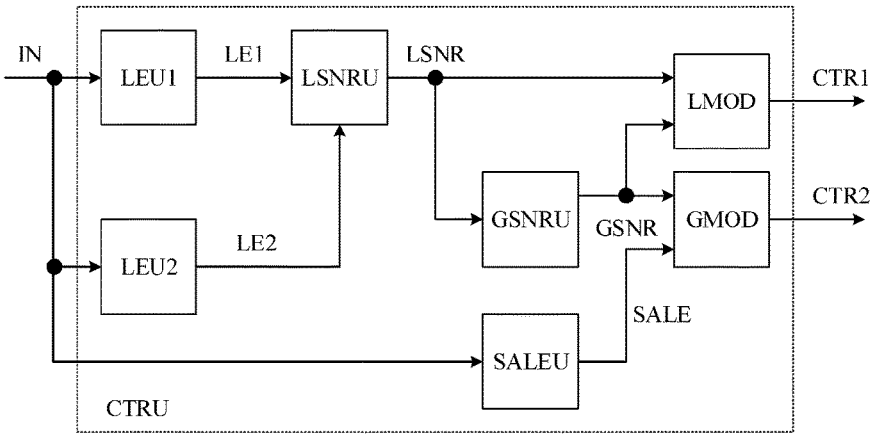
FIG. 2C shows a third embodiment of a control unit for a dynamic compressive amplification system for a hearing device according to the present disclosure.

FIG. 2C shows a third embodiment of a control unit (CTRU) for a dynamic compressive amplification system (SNRCA) for a hearing device (HD) according to the present disclosure. The control unit of FIG. 2C is similar to the embodiments of FIGS. 2A and 2B. The embodiment of a control unit (CTRU) shown in FIG. 2C comprises first and second level estimators (LEU1 and LEU2, respectively) configured to provide first and second level estimates, LE1 and LE2, respectively, of the level of the electric input signal IN. The first and second estimates of the level, LE1 and LE2, are determined using first and second time constants, respectively, wherein the first time constant is smaller than the second time constant. The first and second level estimators, LEU1 and LEU2, thus correspond to (relatively) fast and (relatively) slow level estimators, respectively, providing fast and slow level estimates, LE1 and LE2, respectively. The first and/or the second level estimates LE1, LE2, is/are provided in frequency sub-bands. In the embodiment, of FIG. 2C, the first and second level estimates, LE1 and LE2, respectively, are fed to a first signal-to-noise ratio unit (LSNRU) providing the local SNR (signal LSNR) by processing the fast and slow level estimates, LE1 and LE2. The local SNR (signal LSNR) is fed to a second signal-to-noise ratio unit (GSNRU) providing the global SNR (signal GSNR) by processing the local SNR (e.g. by smoothing (e.g. averaging), e.g. providing a broadband value). In the embodiment of FIG. 2C, the global SNR and the local SNR (signals GSNR and LSNR) are fed to a level modification unit (LMOD) for—based thereon—providing the first control signal CTR1 for modifying a level of the electric input signal in level post processing unit (LPP) of the SNRCA unit (see e.g. FIG. 1). The embodiment of a control unit (CTRU) shown in FIG. 2C further comprises a voice activity detector in the form of a speech absence likelihood estimate unit (SALEU) for identifying time segments of the electric input signal IN (or a processed version thereof) comprising speech, and time segments comprising no speech (voice activity detection), or comprises speech or no speech with a certain probability (voice activity estimation), and providing a speech absence likelihood estimate signal (SALE) indicative thereof. The speech absence likelihood estimate unit (SALEU) is preferably configured to provide the speech absence likelihood estimate signal SALE in a number of frequency sub-bands. In an embodiment, the speech absence likelihood estimate unit SALEU is configured to provide that the speech absence likelihood estimate signal SALE is indicative of a speech absence likelihood. In the embodiment of FIG. 2C, the global SNR and the speech absence likelihood estimate signal SALE are fed to gain modification unit (GMOD) for—based thereon—providing the second control signal CTR2 for modifying a gain the gain post processing units (GPP) of the SNRCA unit (see e.g. FIG. 1).

Figure 2D:
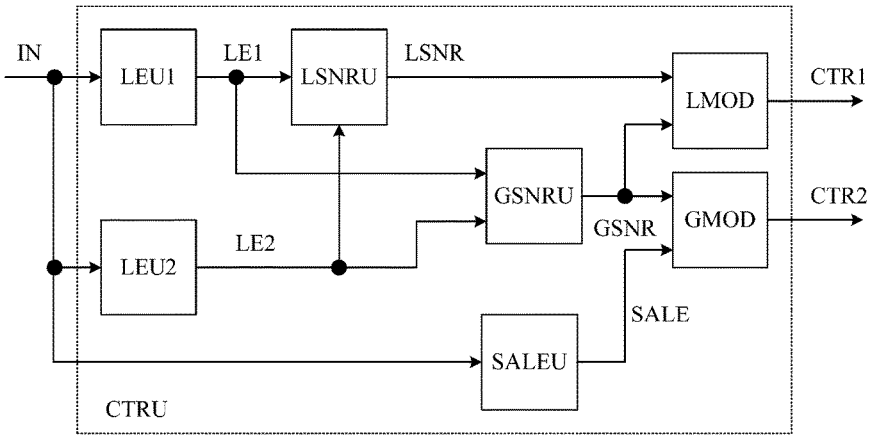
FIG. 2D shows a fourth embodiment of a control unit for a dynamic compressive amplification system for a hearing device according to the present disclosure.

FIG. 2D shows a fourth embodiment of a control unit (CTRU) for a dynamic compressive amplification system (SNRCA) for a hearing device (HD) according to the present disclosure. The control unit of FIG. 2D is similar to the embodiment of FIG. 2C. In the embodiment of a control unit (CTRU) shown in FIG. 2D, however, the second signal-to-noise ratio unit (GSNRU) providing the global SNR (signal GSNR), instead of the local SNR (signal LSNR) receives the first (relatively fast) level estimate LE1 (directly), and additionally, the second (relatively slow) level estimate LE2, and is configured to base the determination of the global SNR (signal GSNR) on both signals.

Figure 2E:
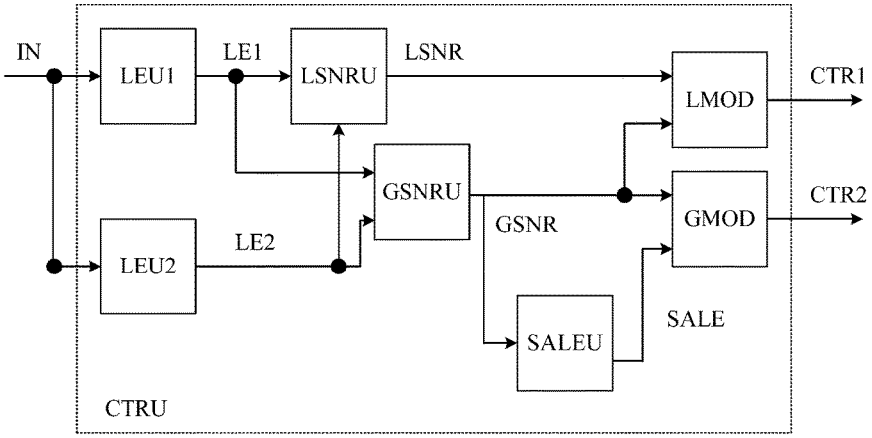
FIG. 2E shows a fifth embodiment of a control unit for a dynamic compressive amplification system for a hearing device according to the present disclosure.

FIG. 2E shows a fifth embodiment of a control unit for a dynamic compressive amplification system for a hearing device according to the present disclosure. The control unit of FIG. 2E is similar to the embodiment of FIG. 2D. In the embodiment of a control unit (CTRU) shown in FIG. 2E, however, the speech absence likelihood estimate unit (SALEU) for providing a speech absence likelihood estimate signal (SALE) indicative of a 'no-speech' environment takes its input GSNR (the global SNR) from the second signal-to-noise ratio unit (GSNRU), i.e. a processed version of the electric input signal IN, instead of the electric input signal IN directly (as in FIG. 2C, 2D).

Figure 2F:
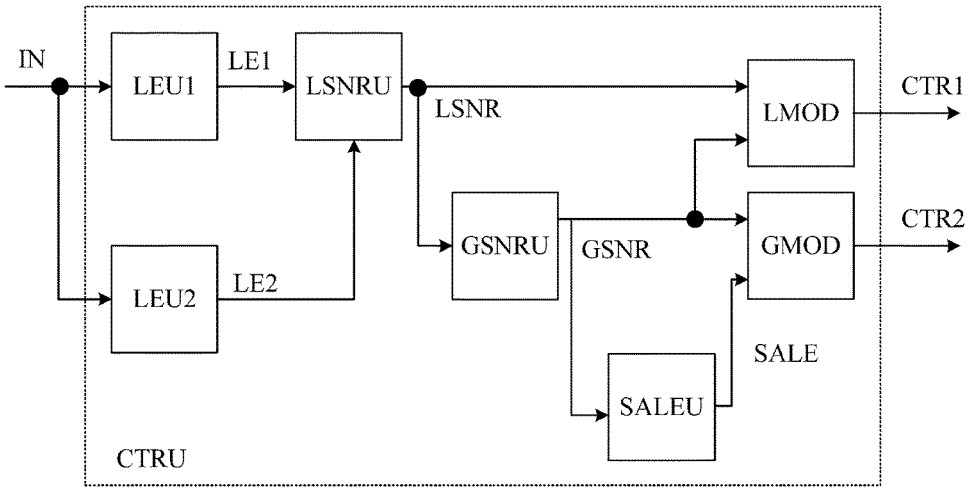
FIG. 2F shows a sixth embodiment of a control unit for a dynamic compressive amplification system for a hearing device according to the present disclosure.

FIG. 2F shows a sixth embodiment of a control unit for a dynamic compressive amplification system for a hearing device according to the present disclosure. The control unit (CTRU) of FIG. 2F is similar to the embodiment of FIG. 2E. In the embodiment of a control unit shown in FIG. 2F, however, the second signal-to-noise ratio unit (GSNRU) providing the global SNR (signal GSNR) is configured to base the determination of the global SNR (signal GSNR) on the local SNR (signal LSNR, as in FIG. 2C) instead of on the first (relatively fast) level estimate LE1 and second (relatively slow) level estimate LE2 (as in FIG. 2D, 2E).

FIG. 3 shows a simplified block diagram for a second embodiment of a hearing device (HD) comprising a dynamic compressive amplification system (SNRCA) according to the present disclosure. The SNRCA unit of the embodiment of FIG. 3 can be divided into five parts:

1. A level envelope estimation stage (comprising units LEU1, LEU2) providing fast and slow level estimates LE1 and LE2, respectively. The level of the temporal envelope is estimated both at a high (LE1) and at a low (LE2) time-domain resolution.

The high time-domain resolution (TDR) envelope estimate (LE1) is an estimate of the modulated temporal envelope at the highest desired TDR. Highest TDR means a TDR that is high enough to contain all the envelope variations, but small enough to remove most of the signal ripples caused by the rectified carrier signal. Such a high TDR provide strongly time localized information about the level of the signal envelope. For this purpose, LEU1 uses the small time constant $\tau_L$. The smoothing effect delivered by LEU1 is designed to provide an accurate and precise modulated envelope level estimate without residual ripples caused by the rectified carrier signal (i.e. the speech temporal fine structure, TFS).

The low time-domain resolution (TDR) envelope estimate (LE2) is an estimate of the temporal envelope average. The envelope modulation is smoothed with a desired strength: LE2 is a global (averaged) observation of the envelope changes. Compared to LEU1, LEU2 uses a low TDR, i.e. a large time constant $\tau_G$.

2. The SNR estimation stage (comprising units NPEU, LSNRU, GSNRU, and SALEU) that may provide and comprise:

Local SNR estimates: short-time and sub-band (cf. detailed description of the unit LSNRU providing signal LSNR below);

Global SNR estimates: long-time and broad-band (cf. detailed description of the unit GSNRU providing signal GSNR below);

The speech absence likelihood estimate stage (unit SALEU) providing signal SALE indicative of the likelihood of a voice being present or not in the electric input signal IN at a given time. For this purpose, any appropriate speech presence probability (i.e. soft-decision) algorithm or smoothed VAD or speech pause detection (smoothed hard-decision) might be used, depending on the desired speech absence likelihood estimate quality (see [Ramirez, Gorriz, Segura, 2007] for an overview of different modern approaches). Note that however, to maintain the required computational resources low current (as is advantageous in battery driven, portable electronic devices, such as hearing aids) it is proposed to re-use the global SNR estimate (signal GSNR) for the speech absence estimation: A hysteresis is applied on the GSNR signal (output is 0 (speech) if the GSNR is high enough or if the output is 1 (no speech) if the GSNR is low enough) followed by a variable time constant low-pass filter. The time constant is controlled by a decision based on the amount of change of the signal GSNR. If the changes are small, the time constant is infinite (frozen update). If the changes are sufficiently large, the time constant is therefore finite. The magnitude of the changes are estimated by applying a non-linear filter on the hysteresis output.

The noise power estimate unit (NPEU) may use any appropriate algorithm. Relative simple algorithms (e.g. [Doblinger; 1995]) or more complex algorithms (e.g. [Cohen & Berdugo, 2002]) might be used depending on the desired noise power estimate quality. However, to maintain the required computational resources low current (as is advantageous in battery driven, portable electronic devices, such as hearing aids), it is proposed to provide a noise floor estimator implementation based on a non-linear low-pass filter that selects the smoothing time constant based on the input signal, similar to [Doblinger; 1995], with an enhancement described below: The decision between attack and release mode is enhanced by an observation of the modulated envelope (re-using LE1) and the modulated envelope average (re-using LE2). The noise power estimator uses a small time constant when the input signal is releasing, otherwise it is use a large time constant similar to [Doblinger; 1995]. The enhancement is as follows: The large time constant might even become infinite (estimate update frozen) when the modulated envelope is above the average envelope (LE1 larger than LE2) or if LE1 is increasing. This design is optimized to deliver a high quality noise power estimate during speech pauses and between-phonemes in natural utterances. Indeed, over-estimating noise on signal segments containing speech (a typical issue in design, similar to [Doblinger; 1995]) does not represent a significant danger like in a traditional noise reduction (NR) application. Although an over-estimated noise power immediately produces an under-estimated local SNR (see unit LSNRU, FIG. 4A), which in turn defines a level offset closer to zero than necessary (see unit LMOD, FIG. 5A), it is likely that there won't be any effect on the level used to feed the compression characteristics. Indeed, the noise power over-estimate is proportional to the speech power. However, the larger the speech power, the greater the chance that, in the unit LPP (FIG. 6A), the fast estimate (signal DBLE1, which is the fast level estimate LE1 converted in dB) is larger than the biased slow estimate (BLE2), and by the selected max function (unit MAX) to feed the compression characteristics.

4. A level envelope post-processing stage (comprising units LMOD and LPP) providing the modified estimated level (signal MLE) obtained by combining the level of the modulated envelope (signal LE1), i.e. the instantaneous or short-term level of the envelope, the envelope average level (signal LE2), i.e. a long-term level of the envelope, as well as a level offset bias (signal CTR1) that depends on the local and global SNR (signals LSNR, GSNR). Compared to the instantaneous short-term level (signal LE1), the modified estimated level (signal MLE) may provide linearized behavior for degraded SNR conditions (compression relaxing).

The compression characteristics (comprising unit L2G providing signal CAG): It is made of a level to gain mapping curve function. This curve generates a channel gain $g_q$, with q=0, . . . , Q−1, for each channel q among the Q different channels using the M sub-bands level estimates as input. The output signal CAG contains $G_q$, the Q channel gains converted in dB, i.e. $G_q=20\log_{10}(g_q)$. If the M estimation sub-bands and the Q gain channels have a 1 to 1 relationship (implying M=Q), the level to gain mapping is simply $g_m=g_m(l_m)$. If such a trivial mapping is not used, e.g. when M<Q, the mapping is done using some interpolation (usually zero-order interpolation for simplicity). In that case, each $g_q$ is potentially a function of the M level estimates $l_m$, i.e. $g_q=g_q(l_0, \ldots, l_{M-1})$, with m=0, . . . , M−1. The mapping is very often realized after converting the level estimates into dB, i.e. $G_q(L_0, \ldots, L_{M-1})$, with $L_m=\log_{10}(l_m)$. As input, though, instead of the 'true' estimate of the level (LE1) of the envelope of the electric input signal IN, it receives the modified (post-processed in LPP unit) level estimate MLE. In other words, MLE contains the M sub-bands level estimates $\tilde{L}_m$ (see LPP unit, FIG. 6A).

5. A gain post-processing stage (comprising units GMOD and GPP providing modified gain (signal MCAG): The speech absence likelihood estimate (signal SALE, cf. also FIG. 2C-2F) controls a gain reduction offset (cf. unit GMOD providing control signal CTR2). Applied on the output of compression characteristics (signal CAG), it relaxes the prescribed gain in pure noise environment providing a modified compressive amplification gain (signal MCAG).

As in the embodiment of FIG. 1, the modified compressive amplification gain (signal MCAG) is applied to a signal of the forward path in forward unit (GAU, e.g. multiplier, if gain is expressed in the linear domain or sum unit, if gain is expressed in the logarithmic domain). As in FIG. 1, the hearing device (HD) further comprises input and output units IU and OU defining a forward path there between. The forward path may be split into frequency sub-bands by an appropriately located filter bank (comprising respective analysis and synthesis filter banks as is well known in the art) or operated in the time domain (broad band).

The forward path may comprise further processing units, e.g. for applying other signal processing algorithms, e.g. frequency shift, frequency transposition beamforming, noise reduction, etc.

Local SNR Estimation (Unit LSNRU)

Figure 4A:
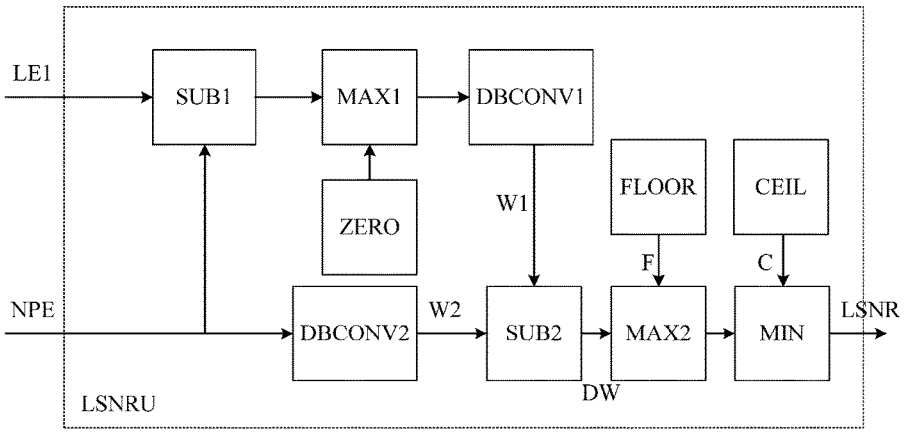
FIG. 4A shows an embodiment of a local SNR estimation unit.

FIG. 4A shows an embodiment of a local SNR estimation unit (LSNRU). The LSNRU unit may use any appropriate algorithm (e.g. [Ephraim & Malah; 1985]) depending on the desired SNR estimate quality. However, to maintain the required computational resources low current (as is advantageous in battery driven, portable electronic devices, such as hearing aids), it is proposed to use an implementation based on the maximum likelihood SNR estimator. Let $l_{m,\tau_L}[n]$ be the output signal (LE1) of the high TDR level estimator (LEU1) in mth sub-band, i.e. the estimate of the time and frequency localized power of the noisy speech $P_{x_m,\tau_L}[n]$, $l_{d_m,\tau_L}[n]$ be the output signal (NPE) of the noise power estimator (NPEU) in the mth sub-band, i.e. the estimate of the time and frequency localized noise power $P_{d_m,\tau_L}[n]$, in sub-band m, and $\xi_{m,\tau_L}[n]$ be the estimate of the input local SNR $SNR_{I,m,\tau_L}$. $\xi_{m,\tau_L}[n]$ is obtained as follows:

$$\xi_{m,\tau_L}[n] = \frac{\max(l_{m,\tau_L}[n] - l_{d_m,\tau_L}[n], 0)}{l_{d_m,\tau_L}[n]}$$

$\Xi_{m,\tau_L}$ is the output signal (LSNR) of the SNR estimator unit (LSNRU). $\Xi_{m,\tau_L}$ is obtained by converting $\xi_{m,\tau_L}[n]$ in decibels:

$$\Xi_{m,\tau_L}=\min(\max(10\log_{10}(\xi_{m,\tau_L}[n]),\Xi_{floor,m}),\Xi_{ceil,m})$$

$$\Xi_{m,\tau_L}=\min(\max(10\log_{10}(\max(l_{m,\tau_L}[n]-l_{d_m,\tau_L}[n],0))-10\log_{10}(l_{d_m,\tau_L}[n]),\Xi_{floor,m}),\Xi_{ceil,m})$$

The saturation is required because without it, the signal $\Xi_{m,\tau_L}$ could reach infinite values (in particular values equal to minus infinity caused by the saturation function used during the computation of $\xi_{m,\tau_L}[n]$). This would typically produce:

Strong quantization errors for $\xi_{m,\tau_L}[n]$ close to 0 and overflow issues for very large $\xi_{m,\tau_L}[n]$.

$\Xi_{m,\tau_L}$ has to be smoothed in a later stage (see Global SNR estimation, GSNRU unit). Without saturation, extreme values will introduce huge lag during smoothing.

The choice of the operational range spanned by $\Xi_{floor,m}$ and $\Xi_{ceil,m}$ must be done such that the smoothed $\Xi_{m,\tau_L}$:

won't become too strongly biased won't lag because of extreme values

Typical values for $[\Xi_{floor,m}, \Xi_{ceil,m}]$ are [−25,100] dB.

In the LSNRU unit, the signal W1 contains the zero-floored (unit MAX1) difference (unit SUB1) of the signals LE1 and NPE, converted in decibel (unit DBCONV1), i.e. $10\log_{10}(\max(l_{m,\tau_L}[n]-l_{d_m,\tau_L}[n],0))$. The signal W2 contains the signal NPE converted into decibels (unit DBCONV2). The unit SUB2 computes DW, the difference between signals W1 and W2, i.e. $10\log_{10}(\max(l_{m,\tau_L}[n]-l_{d_m,\tau_L}[n],0))-10\log_{10}(l_{d_m,\tau_L}[n])$. The unit MAX2 floors DW with signal F, a constant signal with value $\Xi_{floor,m}$ produced by the unit FLOOR. The unit MIN ceils the output of MAX2 unit with signal C, a constant signal with value $\Xi_{ceil,m}$ produced by the unit CEIL. The output signal of MIN is the signal LSNR, which is given by $\Xi_{m,\tau_L}$ as described above.

Global SNR Estimation (Unit GSNRU)

Figure 4B:
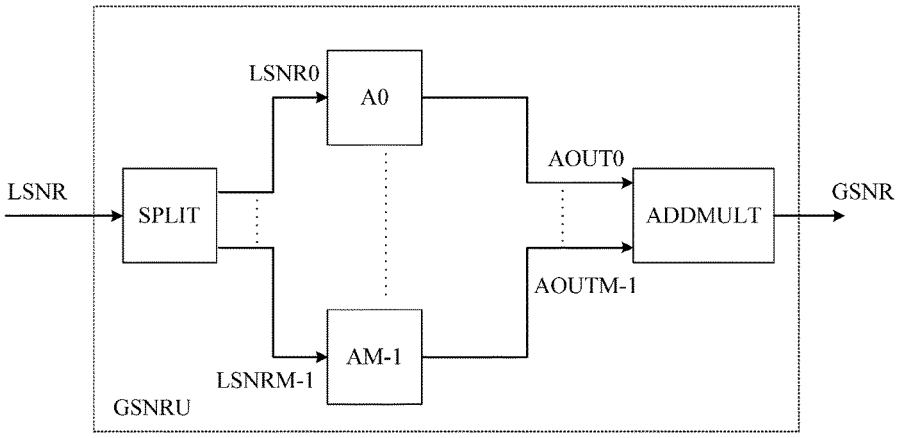
FIG. 4B shows an embodiment of a global SNR estimation unit.

FIG. 4B shows an embodiment of a global SNR estimation unit (GSNRU). The GSNRU unit may use any dedicated (i.e. independent of the local SNR estimation) and appropriate algorithm (e.g. [Ephraim & Malah; 1985]) depending on the desired SNR estimate quality. However, to maintain the required computational resources with low current (as is advantageous in battery driven, portable electronic devices, such as hearing aids), it is proposed to simply estimate the input global SNR by averaging the local SNR over time and frequency in the decibel domain. With $\xi_{\tau_G}[n]$ the estimate of the global SNR $SNR_{I,\tau_G}$ (output signal GSNR of unit GSNRU) and $\xi_{m,\tau_L}[n]$ the estimate of the local SNR $SNR_{I,m,\tau_L}$ (output signal LSNR of unit LSNRU):

$$\Xi_{\tau_G}[n] = \frac{1}{M}\sum_{m=0}^{M-1} A(10\log_{10}(\xi_{m,\tau_L}[n])) = \frac{1}{M}\sum_{m=0}^{M-1} A(\Xi_{m,\tau_L}[n])$$

With A being a linear low pass filter, typically a $1^{st}$ order infinite impulse response filter, configured such that $\tau_G$ is the total averaging time constant, i.e. such that $\Xi_{\tau_G}$ is an estimate of the global input SNR $SNR_{I,\tau_G}$ converted in dB:

$$\xi_{\tau_G}[n] = 10^{(\Xi_{\tau_G}[n]/10)}$$

$\Xi_{\tau_G}[n]$ is the output (signal GSNR) of the GSNRU unit.

In the GSNRU unit, the input signal LSNR that contains the M local SNR estimate $\Xi_{m,\tau_L}[n]$ for m=0, . . . , M−1, is split (unit SPLIT) in M different output signals (LSNR0, LSNR1, LSNR2, . . . LSNRM−1), each of them containing the mth local SNR converted in decibels, i.e. $\Xi_{0,\tau_L}[n]$, $\Xi_{1,\tau_L}[n]$, $\Xi_{2,\tau_L}[n]$, . . . , $\Xi_{M_1,\tau_L}[n]$. The units A0,A1, A2, . . . ,AM−1 applies the linear low-pass filter A on LSNR0, LSNR1, LSNR2, . . . LSNRM−1 respectively, and produces the output signals AOUT0, AOUT1, AOUT2, . . . , AOUTM−1 respectively. These output signals contains $A(\Xi_{0,\tau_L}[n])$, $A(\Xi_{1,\tau_L}[n])$, $A(\Xi_{2,\tau_L}[n])$, . . . $A(\Xi_{M-1,\tau_L}[n])$ respectively. In unit ADDMULT, the signals AOUT0, AOUT1, AOUT2, . . . , AOUTM−1 are summed together and multiplied by a factor 1/M to produce the output signal GSNR that contains $\Xi_{\tau_G}[n]$ as described above.

Figure 5A:
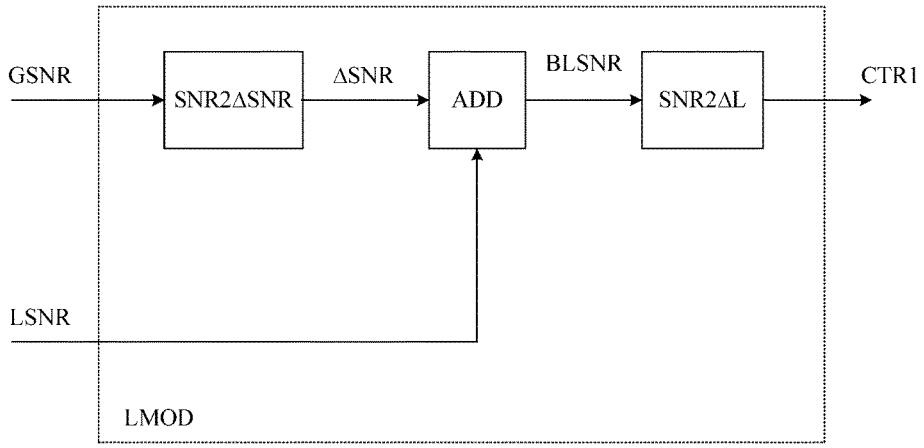
FIG. 5A shows an embodiment of a level modification unit according to the present disclosure.

FIG. 5A shows an embodiment of a Level Modification unit (LMOD). The amount of required linearization (compression relaxing) is computed in the LMOD unit. The output signal CTR1 of the LMOD unit is a level estimation offset, using dB format. The unit LPP (cf. FIG. 3 and FIG. 6A) uses CTR1 to post-process the estimated level LE1 and LE2 such that CA behavior is getting linearized when the input SNR is decreasing. The SNR2ΔL unit contains a mapping function that transforms the biased local estimated SNR (signal BLSNR), into a level estimation offset signal CTR1 (more about that below).

To generate the biased local SNR $B_{m,\tau_L}[n]$ (signal BLSNR), the unit ADD adds an SNR bias $\Delta\Xi_{m,\tau_G}[n]$ (signal ΔSNR) to the local SNR $\Xi_{m,\tau_L}[n]$ (signal LSNR):

$$B_{m,\tau_L}[n]=\Xi_{m,\tau_L}[n]+\Delta\Xi_{m,\tau_G}[n]$$

Unit SNR2ΔSNR produces the SNR bias $\Delta\Xi_{m,\tau_G}[n]$ (signal ΔLSNR) by mapping $\Xi_{\tau_G}[n]$(signal GSNR), the global SNR (cf. GSNRU unit, FIG. 3), for each sub-band m as follows:

$$s = \frac{\Delta\Xi_{max,m} - \Delta\Xi_{min,m}}{\Xi_{max,m} - \Xi_{min,m}}$$

$$h = \Delta\Xi_{min,m} - s\cdot\Xi_{min,m}$$

$$r = -h/s$$

$$\Delta\Xi_{m,\tau_G}[n] = \min(\max(s\cdot(\Xi_{\tau_G}[n] - r), \Delta\Xi_{min,m}), \Delta\Xi_{max,m})$$

With $\Delta\Xi_{min,m}<\Delta\Xi_{max,m}\leq 0$ the smallest respectively largest SNR bias for sub-band m, $\Xi_{min,m}<\Xi_{max,m}$ the threshold SNR values of for sub-bands m where $\Xi_{\tau_G}[n]$ saturates at $\Delta\Xi_{min,m}$ respectively $\Delta\Xi_{max,m}$.

Unit SNR2ΔL produces the level estimation offset $\Delta L_m[n]$ (signal CTR1) by mapping the biased local SNR $B_{m,\tau_G}[n]$ (signal BLSNR) for each sub-band m as follows:

$$s = \frac{\Delta L_{min,m} - \Delta L_{max,m}}{B_{max,m} - B_{min,m}}$$

$$h = \Delta L_{max,m} - s\cdot B_{min,m}$$

$$r = -h/s$$

$$\Delta L_{m,\tau_L}[n] = \min(\max(s\cdot(B_{m,\tau_L}[n] - r), \Delta L_{min,m}), \Delta L_{max,m})$$

With $\Delta L_{min,m}<\Delta L_{max,m}\leq 0$ the smallest respectively largest level estimation offset for sub-band m, $B_{min,m}<B_{max,m}$ the threshold SNR values of for sub-bands m where $B_{m,\tau_L}[n]$ saturates at $\Delta L_{max,m}$ respectively $\Delta L_{min,m}$.

Figure 5B:
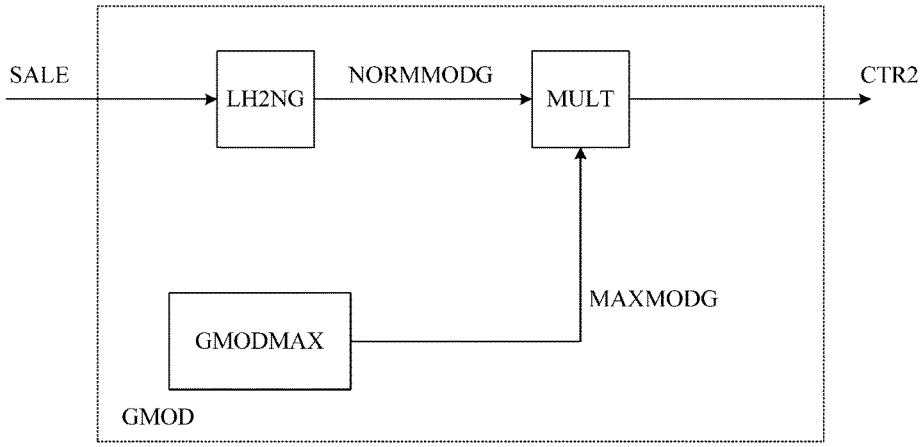
FIG. 5B shows an embodiment of a gain modification unit according to the present disclosure.

FIG. 5B shows an embodiment of a Gain Modification unit (GMOD). The amount of required attenuation (gain relaxing), which is a function of the likelihood of speech absence, is computed in the GMOD unit. The speech absence likelihood (signal SALE) is mapped to a normalized modification gain signal (NORMMODG) in the Likelihood to Normalized Gain unit (LH2NG). The mapping function implemented in the LH2NG unit maps the range of SALE, which is [0,1] to the range of the modification gain NORMMODG, which is also [0,1]. The unit MULT generates the modification gain (output signal CTR2) by multiplying NORMMODG by the constant signal MAXMODG. The GMODMAX unit stores the desired maximal gain modification value that defines the constant signal MAXMODG. This value uses dB format, and is strictly positive. This value is configured in a range that starts at 0 dB and typically spans up to 6, 10 or 12 dB. The mapping function has the following form, for $p_m[n]$ being the speech absence likelihood in sub-band m (signal SALE) and $w_m[n]$ (signal NORMMODG) being the output weight for sub-band m:

$$w_m[n]=\min(f(\max(p_m[n]-p_{tol},0),1/(1-p_{tol})),1)$$

With $p_{tol}$ defining a tolerance (a likelihood below $p_{tol}$ produces a modification gain equal to zero) and f some mapping function that has an average slope of $1/(1-p_{tol})$ over the interval $[p_{tol},1]$. However, to maintain the required computational resources low current (as is advantageous in battery driven, portable electronic devices, such as hearing aids), it is proposed to simply make f linear over $[p_{tol},1]$, i.e.

$$w_m[n]=\min(1/(1-p_{tol})\cdot\max(p_m[n]-p_{tol},0),1)$$

Typically, the smallest value for $p_{tol}$ is $p_{tol}=1/2$.

When the speech absence likelihood estimate $p_m[n]$ (signal SALE), provided by the unit SALEU (FIG. 3) goes beyond $p_{tol}$, the gain reduction offset, i.e. the modification gain (signal CTR2) becomes non-zero.

The signal CTR2 increases proportionally to the signal SALE and reaches its maximal value MAXMODG when the SALE is equal to 1.

Figure 6A:
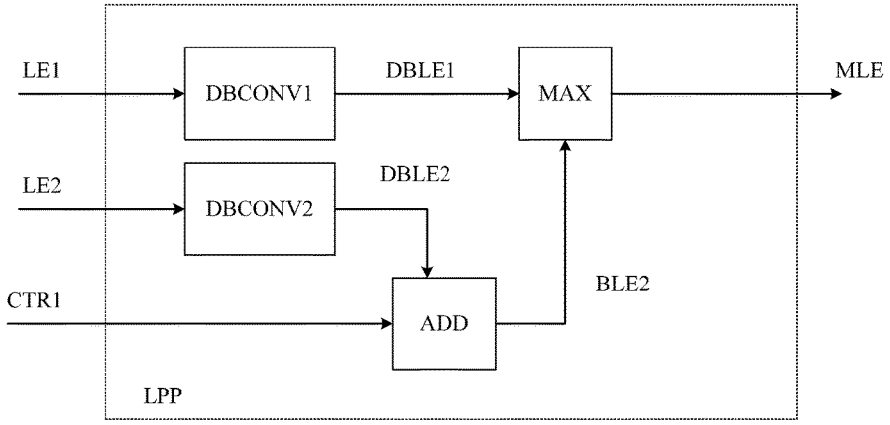
FIG. 6A shows an embodiment of a level post processing unit according to the present disclosure.

FIG. 6A shows an embodiment of the Level Post-Processing unit (LPP). The required linearization (compression relaxing) is applied in the LPP unit. The level estimates (input signals LE1 and LE2) are first converted into dB in the DBCONV1 and DBCONV2 unit respectively:

$$L_{m,\tau_L}[n]=10\log_{10} l_{m,\tau_L}[n]$$

And $$L_{m,\tau_G}[n]=10\log_{10} l_{m,\tau_G}[n]$$

The LPP unit output $\tilde{L}_{m,\tau}[n]$ (signal MLE) is obtained by combining, for each sub-band m, the local and global level estimates ($L_{m,\tau_L}[n]$ respectively $L_{m,\tau_G}[n]$) with the level offset $\Delta L_{m,\tau_L}[n]$ (signal CTR1) from the LMOD unit as follows:

$$\tilde{L}_{m,\tau}[n]=\max(\Delta L_{m,\tau_L}[n]+L_{m,\tau_G}[n],L_{m,\tau_L}[n])$$

Figure 6B:
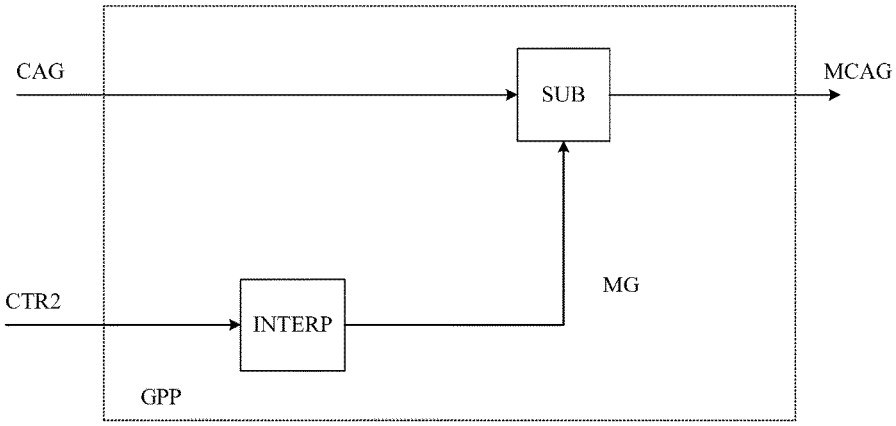
FIG. 6B shows an embodiment of a gain post processing unit according to the present disclosure.

FIG. 6B shows an embodiment of the Gain Post-Processing unit (GPP). The required attenuation (gain relaxing) is applied in the GPP unit. To produce the output signal MCAG (modified CA gain), the GPP unit uses 2 inputs: The signal CAG (CA gain), which is the output of the Level to Gain map unit (L2G), and the signal CTR2, which is the output of the GMOD unit. Both are formatted in dB. The signal CTR2 contains the gain correction that have to be subtracted from CAG to produce MCAG. The unit SUB performs this subtraction.

However, in the unit L2G (cf. FIG. 3), it is often the case that the gains (signal CAG) use a different and/or higher FDR than the estimated levels (signal MLE). The estimated levels $\tilde{L}_{m,\tau}[n]$ (signal MLE) are (usually zero-order) interpolated before being mapped to the gains $G_q[n]=G_q(L_{0,\tau}[n],\ldots,L_{M-1,\tau}[n])$ (signal CAG) with $q=0,\ldots,Q-1$. In that case, the gain correction (signal CTR2) must be fed into a similar interpolation stage (unit INTERP) to produce an interpolated modification gain (signal MG) with the FDR used by CAG. MG can be subtracted from CAG (in unit SUB) to produce the modified CA gain (MCAG).

Figure 7:
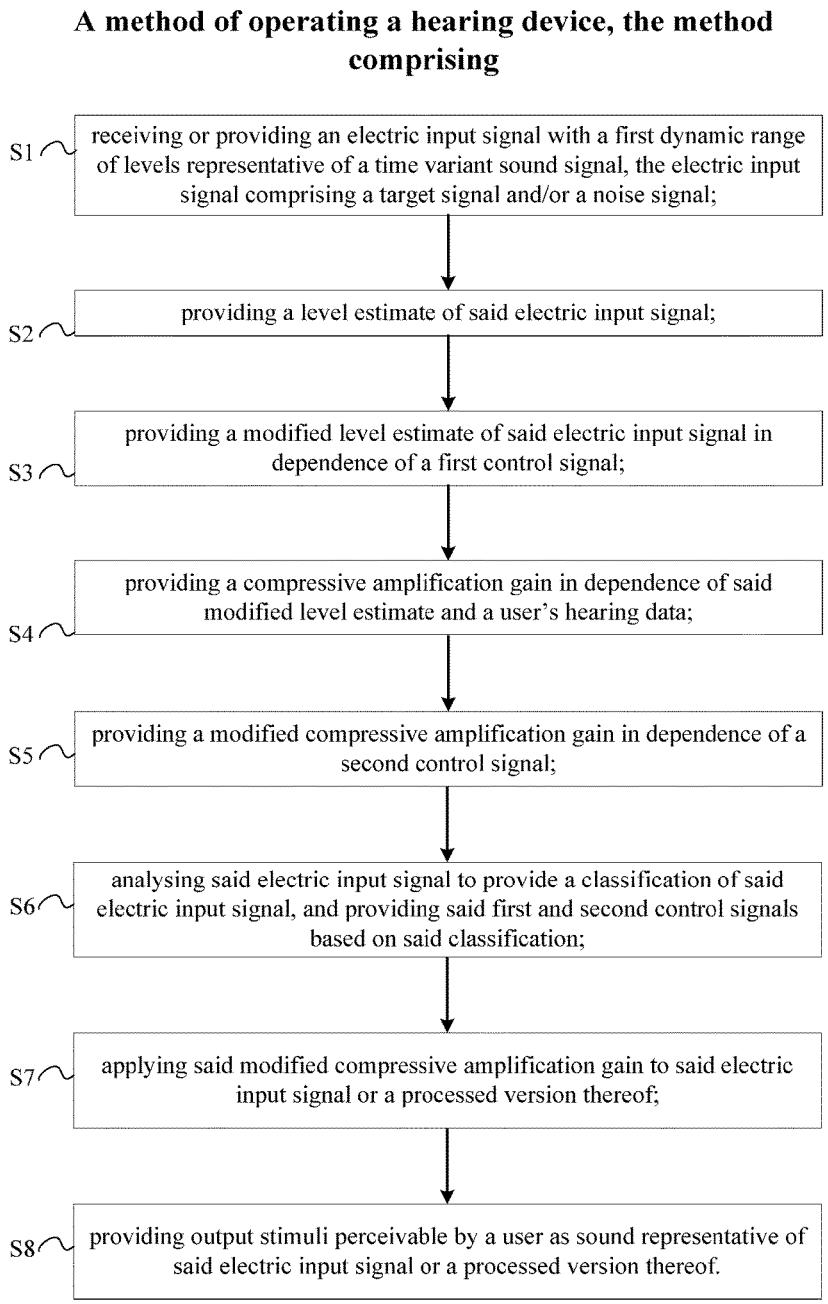
FIG. 7 shows a flow diagram for an embodiment of a method of operating a hearing device according to the present disclosure.

FIG. 7 shows a flow diagram for an embodiment of a method of operating a hearing device according to the present disclosure. The method comprises steps S1-S8 as outlined in the following.

S1 receiving or providing an electric input signal with a first dynamic range of levels representative of a time variant sound signal, the electric input signal comprising a target signal and/or a noise signal;

S2 providing a level estimate of said electric input signal;

S3 providing a modified level estimate of said electric input signal in dependence of a first control signal;

S4 providing a compressive amplification gain in dependence of said modified level estimate and hearing data representative of a user's hearing ability;

S5 providing a modified compressive amplification gain in dependence of a second control signal;

S6 analysing said electric input signal to provide a classification of said electric input signal, and providing said first and second control signals based on said classification;

S7 applying said modified compressive amplification gain to said electric input signal or a processed version thereof; and S8 providing output stimuli perceivable by a user as sound representative of said electric input signal or a processed version thereof.

Some of the steps may, if convenient or appropriate, be carried out in another order than outlined above (or indeed in parallel).

Figure 8A:
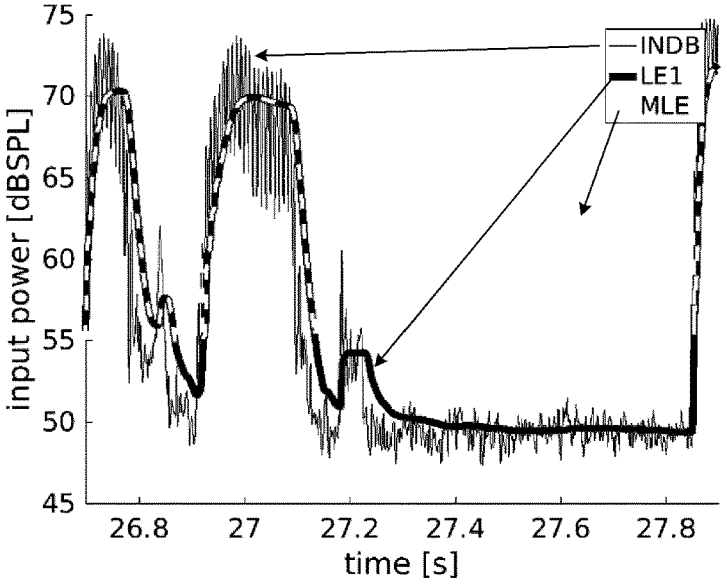
FIG. 8A shows the temporal level envelope estimates of CA and SNRCA for noisy speech.

FIG. 8A shows different temporal level envelope estimates. Signal INDB is the squared and into decibel converted input signal IN of FIG. 3. (dB SPL versus time [s]). The level estimate LE1 is the output of the high time domain resolution (TDR) level estimator LEU1. It represents typically the level estimate produced by classic CA schemes tuned for phonemic time domain resolution: Phonemes are individually level estimated. However, such a high precision tracking delivers high gain for the speech pauses (input SNR equal to minus infinity) or strongly noise corrupted soft phonemes (very negative input SNR). On the other hand, the level estimate MLE used by SNRCA (output signal of the unit LPP on FIG. 6A) fades against the long term level during speech pauses or on soft phonemes that are too strongly corrupted by noise. On such low local input SNR signal segments, the amplification is linearized, i.e. the compression is relaxed. In addition, the MLE is equal to LE1 during loud phonemes to guarantee the expected compression and avoid over-amplification. On such high local input SNR, the amplification is not linearized, i.e. the compression is not relaxed.

Figure 8B:
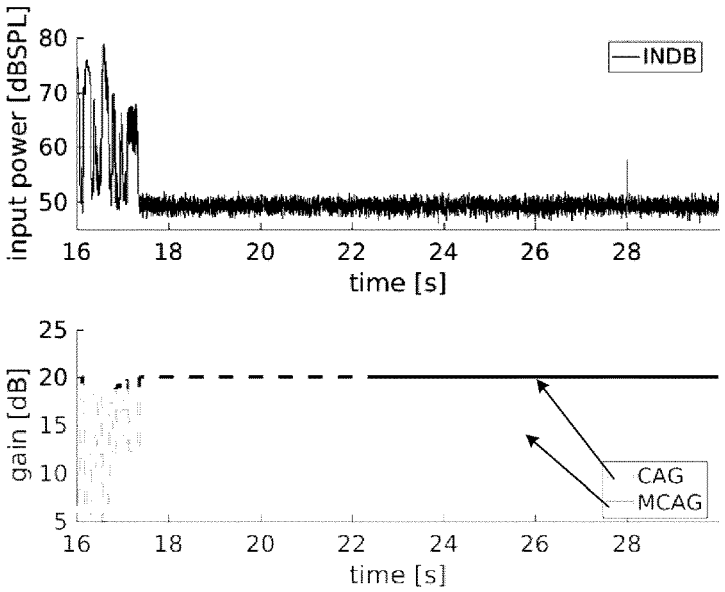
FIG. 8B shows the amplification gain delivered by CA and SNRCA for a noise only signal segment.

FIG. 8B shows the gain delivered by CA and SNRCA on signal segments where speech is absent. On the top of the figure, the signal INDB is the squared and into dBSPL converted input signal IN of FIG. 3. It contains noisy speech up to second 17.5, and then noise only. There is a noisy click at second 28. On the bottom of the figure, the gain CAG is the output of the L2G unit (see FIG. 3). It represents typically the gain produced by classic CA schemes. High gain is delivered on the low level background noise. On the other hand, the gain MCAG (output of the GPP unit, see FIG. 3), which is used by SNRCA, is relaxed after a few seconds. The SNRCA, via the SALEU unit (see FIG. 3) recognizes that input global SNR is low enough. This means that speech is not present anymore. The amplification is reduced. Note that the system is robust against potential non-steady noise, e.g. the impulsive noise click located at second 28: The gain is maintained relaxed.

Figure 8C:
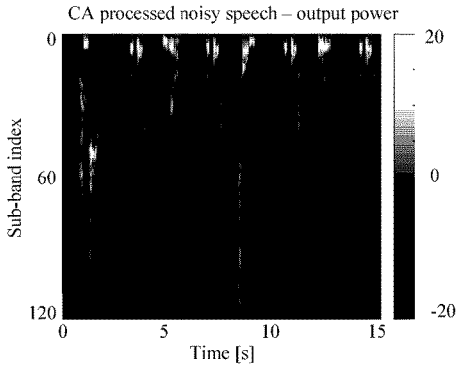
FIG. 8C shows a spectrogram of the output of CA processing noisy speech.

FIG. 8C shows a spectrogram of the output of CA processing noisy speech. During speech pauses or soft phonemes, the background noise receives relatively high gain. Such a phenomenon is called "pumping" and is typically a time-domain symptom of SNR degradation.

Figure 8D:
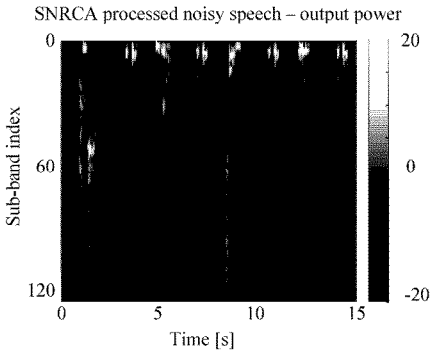
FIG. 8D shows a spectrogram of the output of SNRCA processing noisy speech.

FIG. 8D shows a spectrogram of the output of SNRCA processing noisy speech. During speech pauses or soft phonemes, the background noise gets much less gain compared to CA processing (FIG. 8C), because the amplification is linearized, i.e. the compression is relaxed. This strongly limit the SNR degradation.

Figure 8E:
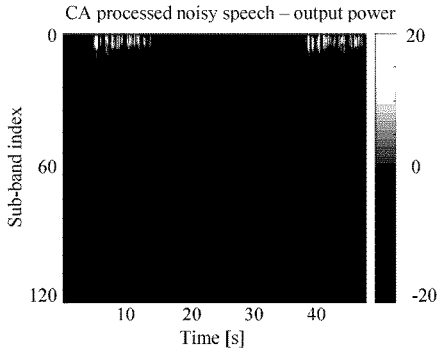
FIG. 8E shows a spectrogram of the output of CA processing noisy speech.
Figure 8F:
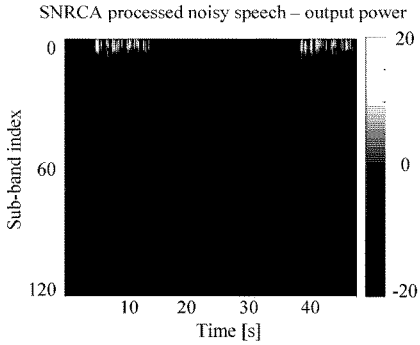
FIG. 8F shows a spectrogram of the output of SNRCA processing noisy speech.

FIG. 8E shows a spectrogram of the output of CA processing noisy speech. When speech is absent (approximately from second 14 to second 39), the background noise receives very high gain, producing undesired noise amplification FIG. 8F shows a spectrogram of the output of SNRCA processing noisy speech. When speech is absent (approximately from second 14 to second 39), the background noise does not gets very high gain once the SNRCA has recognized that speech is absent and starts to relax the gain (approximately at second 18), avoiding undesired noise amplification.

In total summary, traditional compressive amplification (CA) is designed (i.e. prescribed by fitting rationales) for speech in quiet. CA with real world (noisy) signals has the following properties (both in time and frequency domain):

a) the SNR at the output of compressor is smaller than the SNR at the input of the compressor, if the input SNR>0 (SNR DEGRADATION), b) the SNR at the output of the compressor is larger than the SNR at the input of the compressor, if the input SNR<0 (SNR IMPROVEMENT), c) that situation (b) is unlikely, in particular with the use of a noise reduction, d) when the SNR at the input of the compressor tends towards minus infinity (noise only), it is probably better not to amplify at all.

Conclusion from (a): compression might be a bad idea if the signal is noisy. Idea: relaxing the compression as function of the SNR.

Conclusion from (d): pure noise signal are not strongly modulated, so the compression ratio (as a function of the time constants, number of channels and static compression ratios in the gain map) has a limited influence. Idea: On the other hand, it might be reasonable to relax the amplification because the applied gain is defined for clean speech at the same level.

SNRCA concept/idea: drive the compressive amplification using SNR estimation(s).

Linearize the compressor (compression relax) if the signal is noisy.

Decrease the gain (gain relax) if the signal is pure noise (apply attenuation at the output of the gain map).

SNRCA concept according to the present disclosure is NOT a noise reduction system, but in fact is complementary to the noise reduction. The better the noise reduction, the more benefits such a system can bring. Indeed, the better the NR, the greater the chances to have a positive SNR at the input of the compressor.

Embodiments of the disclosure may e.g. be useful in applications where dynamic level compression is relevant such as hearing aids. The disclosure may further be useful in applications such as headsets, ear phones, active ear protection systems, hands free telephone systems, mobile telephones, teleconferencing systems, public address systems, karaoke systems, classroom amplification systems, etc.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

ABBREVIATIONS

| Term | Definition |
|---|---|
| CA | Compressive Amplification |
| CAG | Compressive Amplification Gain |
| Clean speech | A speech signal in isolation without the presence of any other acoustic signal. |
| Compression Relaxing | Linearization of the amplification for degraded SNRs |
| CLU | Classification Unit |
| CTRU | Control Unit |
| CTR | Control Signal |
| dB | Decibel |
| dBSPL | Decibel Sound Pressure Level |
| DET | Detector |
| DSL | Desired Sensation Level - a generic fitting rationale developed at Western University, London, Ontario, Canada |
| FDR | Frequency Domain Resolution |
| Gain Relaxing | Reduction in amplification in the presence of a very low SNR (pure noise) |
| GAU | Gain Application Unit |
| GPP | Gain post processing unit |
| GMOD | Gain Modification Unit |
| GSNR | Global Signal to Noise Ratio Estimate |
| GSNRU | Global Signal to Noise Ratio Estimation Unit |
| HA | Hearing aid |
| HI | Hearing instrument - same as hearing aid |
| HD | Hearing device - any instrument that includes a hearing aid that provide amplification to alleviate the negative effects of hearing impairment |
| HLC | Hearing Loss Compensation |
| HLD | Hearing Level Data - a measure of the hearing loss |
| IN | Electrical input signal |
| IU | Input unit |
| LPP | Level post processing unit |
| L2G | Level to gain unit |
| LSNR | Local Signal to Noise Ratio Estimate |
| LSNRU | Local Signal to Noise Ratio Estimation Unit |
| MCAG | Modified Compressive Amplification Gain |
| MLE | Modified Level Estimate |
| NAL | National Acoustic Laboratories (Australia) |
| NPEU | Noise Power Estimate Unit |
| NPE | Noise Power Estimate |
| NR | Noise Reduction |
| OU | Output unit |
| OUT | Electrical output signal |
| SAL | Speech Absence Likelihood |
| SALE | Speech Absence Likelihood Estimate |
| SALEU | Speech Absence Likelihood Estimate Unit |
| SNR | Signal to Noise Ratio |
| SNRCA | SNR driven compressive amplification system |

-continued

| ABBREVIATIONS | |
|---|---|
| Term | Definition |
| STA | Status signals |
| TDR | Time Domain Resolution |
| USD | User specific data signal |

REFERENCES

[Keidser et al.; 2011] Keidser G, Dillon H, Flax M, Ching T, Brewer S. (2011). The NAL-NL2 prescription procedure. Audiology Research, 1:e24.

[Scollie et al.; 2005] Scollie, S, Seewald, R, Cornelisse, L, Moodie, S, Bagatto, M, Laurnagaray, D, Beaulac, S, & Pumford, J. (2005). The Desired Sensation Level Multistage Input/Output Algorithm. Trends in Amplification, 9(4): 159-197.

[Naylor; 2016)], Naylor, G. (2016). Theoretical Issues of Validity in the Measurement of Aided Speech Reception Threshold in Noise for Comparing Nonlinear Hearing Aid Systems. Journal of the American Academy of Audiology, 27(7), 504-514.

[Naylor & Johannesson; 2009], Naylor, G. & Johannesson, R. B. (2009). Long-term Signal-to-Noise Ratio (SNR) at the input and output of amplitude compression systems. Journal of the American Academy of Audiology, Vol. 20, No. 3, pp. 161-171.

[Doblinger; 1995] Doblinger, Gerhard. "Computationally efficient speech enhancement by spectral minima tracking in subbands." Power 1 (1995): 2.

[Cohen & Berdugo, 2002] Cohen, I., & Berdugo, B. (2002). Noise estimation by minima controlled recursive averaging for robust speech enhancement. *IEEE signal processing letters,* 9(1), 12-15.

[Ephraim & Malah; 1985], Ephraim, Yariv, and David Malah. "Speech enhancement using a minimum mean-square error log-spectral amplitude estimator." Acoustics, Speech and Signal Processing, IEEE Transactions on 33.2 (1985): 443-445.

[Ramirez, Gorriz, Segura, 2007] J. Ramirez, J. M. Gorriz and J. C. Segura (2007). Voice Activity Detection. Fundamentals and Speech Recognition System Robustness, Robust Speech Recognition and Understanding, Michael Grimm and Kristian Kroschel (Ed.).

[Peterson and Barney, 1952] Peterson, G. E., & Barney, H. L. (1952). Control methods used in a study of the vowels. The Journal of the acoustical society of America, 24(2), 175-184.

[Ladefoged, 1996] Ladefoged, P. (1996). Elements of acoustic phonetics. University of Chicago Press.

[Moore, 2008] Moore, B. C. J. (2008). The choice of compression speed in hearing aids: theoretical and practical considerations and the role of individual differences. Trends in Amplification, 12(2), 103-12.

[Moore, 2014] Moore, B. C. J. (2014). Auditory Processing of Temporal Fine Structure: Effects of Age and Hearing Loss. World Scientific Publishing Company Ltd. Singapore.

[Souza & Kitch, 2001] Souza, P, E. & Kitch, V. (2001). The contribution of amplitude envelope cues to sentence identification in young and aged listeners. Ear and Hearing, 22(4), 112-119.

The invention claimed is:

1. A hearing device, e.g. a hearing aid, configured to be located at the ear or fully or partially in the ear canal of a user, or for being fully or partially implanted in the head of a user, the hearing device comprising An input unit for receiving or providing an electric input signal with a first dynamic range of levels representative of a time and frequency variant sound signal, the electric input signal comprising a target signal and/or a noise signal;

An output unit for providing output stimuli perceivable by a user as sound representative of said electric input signal or a processed version thereof; and A dynamic compressive amplification system comprising A level detector unit for providing a level estimate of said electric input signal;

A level post processing unit for providing a modified level estimate of said electric input signal in dependence of said level estimate and a first control signal;

A level compression unit for providing a compressive amplification gain in dependence of said modified level estimate and hearing data representative of a user's hearing ability;

A gain post processing unit for providing a modified compressive amplification gain in dependence of said compressive amplification gain and a second control signal; and A control unit configured to analyse said electric input signal and to provide a classification of said electric input signal and providing said first and second control signals based on said classification; and A forward gain unit for applying said modified compressive amplification gain to said electric input signal or a processed version thereof.

2. A hearing device according to claim 1, wherein said classification of said electric input signal is indicative of a current acoustic environment of the user.

3. A hearing device according to claim 1, wherein the control unit is configured to provide said classification according to a current mixture of target signal and noise signal components in the electric input signal or a processed version thereof.

4. A hearing device according to claim 1 comprising a voice activity detector for identifying time segments of an electric input signal comprising speech and time segments comprising no speech, or comprises speech or no speech with a certain probability, and providing a voice activity signal indicative thereof.

5. A hearing device according to claim 4 wherein said second control signal is determined in dependence of said voice activity signal.

6. A hearing device according to claim 1, wherein the control unit is configured to provide said classification in dependence of a current target signal to noise signal ratio.

7. A heating device according to claim 1, wherein the electric input signal is received or provided as a number of frequency sub-band signals.

8. A hearing device according to claim 1 comprising a memory wherein said hearing data of the user or data or algorithms derived therefrom are stored.

9. A hearing device according to claim 1, wherein the level detector unit is configured to provide an estimate of a level of an envelope of the electric input signal.

10. A hearing device according to claim 1 comprising first and second level estimators configured to provide first and second estimates of the level of the electric input signal, respectively, the first and second estimates of the level being determined using first and second time constants, respectively, wherein the first time constant is smaller than the second time constant.

11. A hearing device according to claim 1 wherein said control unit is configured to determine first and second signal to noise ratios of the electric input signal or a processed version thereof, wherein said first and second signal-to-noise ratios are termed local SNR and global SNR, respectively, and wherein the local SNR denotes a relatively short-time ($\tau_L$) and sub-band specific ($\Delta f_L$) signal-to-noise ratio and wherein the global SNR denotes a relatively long-time ($\tau_G$) and broad-band ($\Delta f_G$) signal to noise ratio, and wherein the time constant $\tau_G$ and frequency range $\Delta f_G$ involved in determining the global SNR are larger than corresponding time constant $\tau_L$ and frequency range $\Delta f_L$ involved in determining the local SNR.

12. A hearing device according to claim 11, wherein said first control signal is determined based on said first and second signal to noise ratios.

13. A hearing device according to claim 1 wherein said second control signal is determined based on a smoothed signal to noise ratio of said electric input signal or a processed version thereof.

14. A hearing device according to claim 1 comprising a hearing aid, a headset, an earphone, an ear protection device or a combination thereof.

15. Use of a hearing device as claimed in claim 1.

16. A method of operating a hearing device, the method comprising receiving or providing an electric input signal with a first dynamic range of levels representative of a time and frequency variant sound signal, the electric input signal comprising a target signal and/or a noise signal;

providing a level estimate of said electric input signal;

providing a modified level estimate of said electric input signal in dependence of said level estimate and a first control signal;

providing a compressive amplification gain in dependence of said modified level estimate and a user's hearing data;

providing a modified compressive amplification gain in dependence of said compressive amplification gain and a second control signal, analysing said electric input signal to provide a classification of said electric input signal, and providing said first and second control signals based on said classification;

applying said modified compressive amplification gain to said electric input signal or a processed version thereof; and providing output stimuli perceivable by a user as sound representative of said electric input signal or a processed version thereof.

17. A data processing system comprising a processor and program code means for causing the processor to perform the steps of the method of claim 16.

* * * * *